United States Patent [19]

Abraham

[11] Patent Number: 4,711,342

[45] Date of Patent: Dec. 8, 1987

[54] CONVEYOR TRANSFER APPARATUS FOR FOUNDRY USE AND METHOD OF CONVEYOR TRANSFER

[75] Inventor: Edward D. Abraham, Brecksville, Ohio

[73] Assignee: Lucille S. Abraham, Brecksville, Ohio

[21] Appl. No.: 685,594

[22] Filed: Dec. 24, 1984

Related U.S. Application Data

[63] Continuation-in-part of Ser. No. 339,172, Jan. 13, 1982, abandoned.

[51] Int. Cl.[4] ..... B65G 25/00

[52] U.S. Cl. ..... 198/463.3; 198/468.8; 198/468.9; 198/775; 198/955; 414/525 B; 414/750

[58] Field of Search ..... 198/774, 775, 468.8, 198/468.9, 463.3, 614, 468.6, 776, 955; 414/525 B, 750

[56] References Cited

U.S. PATENT DOCUMENTS

| | | | |
|---|---|---|---|
| 2,857,034 | 10/1958 | Griswold | 198/775 |
| 2,883,031 | 4/1959 | MacCurdy | 198/468.6 |
| 2,918,711 | 12/1959 | Herbruggen | 164/324 |
| 2,985,926 | 5/1961 | Fellows | 164/226 |
| 3,254,376 | 6/1966 | Burnett | 164/323 |
| 3,322,259 | 5/1967 | Milazzo | 198/774 |
| 3,565,241 | 2/1971 | Race et al. | 198/774 |
| 3,576,246 | 4/1971 | Hulet et al. | 198/468.6 |
| 3,871,534 | 3/1975 | Bursk | 198/776 |
| 3,904,022 | 9/1975 | Lutz | 198/614 |
| 4,068,695 | 1/1978 | Seaman | 198/468.6 |
| 4,071,137 | 1/1978 | Fink | 198/774 |
| 4,102,450 | 7/1978 | Chapman et al. | 198/774 |
| 4,219,113 | 8/1980 | Fieser et al. | 198/774 |
| 4,236,626 | 12/1980 | Noe | 198/774 |
| 4,357,128 | 11/1982 | Gooden et al. | 198/774 |
| 4,512,280 | 4/1985 | Lee, Jr. | 198/774 |

FOREIGN PATENT DOCUMENTS

| | | | |
|---|---|---|---|
| 2732977 | 2/1979 | Fed. Rep. of Germany | 198/468.6 |
| 1592758 | 7/1981 | United Kingdom | 198/774 |
| 891527 | 12/1981 | U.S.S.R. | 198/614 |
| 905167 | 2/1982 | U.S.S.R. | 198/774 |

*Primary Examiner*—Joseph E. Valenza
*Assistant Examiner*—Jonathan D. Holmes
*Attorney, Agent, or Firm*—Robert R. Hussey

[57] ABSTRACT

A conveyor transfer system is used in a foundry to transfer an article between first and second article-travel-paths. The system includes a first conveyor which has a pair of beams defining the first article-travel-path. One of the beams is movable in a vertical direction to lift an article from the other beam and for placing an article supported by the one beam on the other beam. One of the beams is movable in a horizontal direction to move an article supported thereby along the first article-travel-path. A second conveyor is provided having a pair of beams defining the second article-travel-path. The beams of the second conveyor function similar to the corresponding beams of the first conveyor. A shuttle conveyor is provided for transporting an article between the first and second conveyors. The shuttle conveyor has a first portion in alignment with the first article-travel-path to form a continuation thereof. A second portion of the shuttle conveyor is positioned in alignment with the second article-travel-path to form a continuation thereof. The shuttle conveyor also provides for transferring an article from the first portion to the second portion of the shuttle conveyor. Methods for the practice of the above system are also provided.

9 Claims, 21 Drawing Figures

CONVEYOR TRANSFER APPARATUS FOR FOUNDRY USE AND METHOD OF CONVEYOR TRANSFER

CROSS REFERENCE TO RELATED APPLICATION

This application is a continuation-in-part of Application Ser. No. 06/339,172 filed Jan. 13, 1982 now abandoned.

BACKGROUND OF THE INVENTION

The present invention relates to conveyors and more particularly to conveyors which are especially suited for use in a foundry.

Modern foundries produce many castings daily. For each individual casting a separate mold must be made. To facilitate production, these molds are made in assembly line fashion with conveyors interconnecting the various work stations on the production line.

In the layout of a foundry system, it is commonly necessary to connect two parallel conveyors so that an article, such as a mold, may be moved from one conveyor to the other. Another common necessity in the layout of a foundry system is to minimize the space necessary for the foundry system. The above prerequisites require a conveyor system which conveys the molds between the various fixed equipment which performs certain operations in the construction of the molds. In order to reduce the necessary space required by a foundry system, it is commonly necessary to transfer the mold between two conveyors.

There are known conveyors which can move articles in a number of different directions in a foundry. Some foundry conveyor systems have used cars which run on rails to interconnect parallel conveyors. Since the molds are made of ceramic materials, such as sand, it is inevitable that during the transport of the molds some sand will fall from the mold. In a railed conveyor system, the sand accumulates on the rails and causes abrasion of the wheels and the track. In addition, if the car is self-propelled, the deposits of sand on the rails may be thick enough to prevent good traction between the rails and the wheels. These difficulties have been overcome by using dirt shields and wipers to keep the wheels and track free of sand. However, the wipers and shields reduce reliability and increase maintenance costs since they themselves are prone to failure and require frequent maintenance. Furthermore, the expense of such conveyor cars and their associated equipment have been another disadvantage in their use in a foundry conveyor system.

Another known foundry conveyor system for transferring an article between two conveyors is described in Herbruggen, U.S. Pat. No. 2,918,711. A carriage which supports an article thereon is disclosed with a fluid actuated double acting piston-cylinder unit to move the article across rollers supporting the article onto the rollers of the carriage. The carriage, which is supported by rollers on another conveyor, is then moved to a second position where the article can be rolled off the carriage and onto another roller conveyor system by means of another double acting fluid actuated piston and cylinder unit. Accordingly, the direction of movement of the article is changed.

Other known transfer devices which use piston-cylinder units include transferring the article from a conveyor line to gravity rollers, from the gravity rollers to power rollers and from the power rollers again to gravity rollers.

It should be understood that the weight of the article, such as a mold, to be transferred in a foundry transfer system is extremely heavy and that it is desirable to design the equipment to transfer such an article in a most economical fashion. In order to move such heavy articles, the cost of piston-cylinder units and the like is extremely high due to the substantial forces that they are required to generate in performing the transfer function required. Also, the associated limit switches, valves, and fluid circuits required are extremely complex and require substantial costs to be expended in their construction. Furthermore, the synchronization of the piston-cylinder units in such transfer devices is difficult.

When such devices as powered rollers and cylinders are utilized in which a portion thereof comes in contact with the article to be transferred, substantial wear occurs therebetween. In the case of powered rollers, the bottom of the article is worn. In the case of cylinders, the side of the article is "peened" when the fluid cylinder comes into contact with the article and drives it from one conveyor system to the other.

In addition, such known devices require additional space for the positioning of the location of the transfer devices and therefore are further inefficient.

Furthermore, the rollers of such known devices become worn out due to sand from the molds entering the rollers' bearings. This sand deteriorates the bearings and accordingly necessitates the replacement of the worn rollers.

The present invention is the result of a unique mechanical and electrical combination which permits the transfer of an article from one conveyor to another at a minimum of cost, wear on the article, space required by the system, and allows for synchronization of the transfer of the article from one conveyor system to another.

BRIEF DESCRIPTION OF THE INVENTION

The novel conveyor transfer system of the present invention for use in a foundry and the method of same provides for transferring an article between first and second article-travel-paths.

A first conveyor is provided which has at least one movable beam and a support member defining the first article-travel-path. Means are provided for moving the movable beam of the first conveyor in a vertical direction to lift an article supported on the support member and to place on the support member an article supported by the movable beam. The moving means is also capable of moving the movable beam in a horizontal direction to move an article supported thereon along the first article-travel-path. A second conveyor is provided having a movable beam, a support member and means for moving the movable beam similar to that described in connection with the first conveyor. A shuttle conveyor is provided for transporting an article between the first and second conveyors. The shuttle conveyor has a first portion positioned in alignment with the first article-travel-path to form a continuation thereof. The shuttle conveyor also has a second portion positioned in alignment with the second article-travel-path to form a continuation thereof. The shuttle conveyor has transfer means for transferring an article from the first portion to the second portion of the shuttle conveyor means. The movable beams are positioned so that they will place an article on or remove an article from the portion of the shuttle conveyor in alignment with its respective article-travel-path.

The use of a conveyor having a movable beam and a support member for moving an article along a path of the construction contemplated by this invention is particularly advantageous in foundry use. This "walking beam" conveyor transfers articles along a path by a series of sequential "stepping" operations. The movable or "walking" beam is raised to pick up an article from the support member, is moved in a horizontal direction to move the article along the path, is lowered in a vertical direction to place the article on the support member and then returns to its original position.

The molds transported on a conveyor system in a foundry are made of sand. Some of the sand falls from the mold onto the conveyor. This is particularly true in the areas close to the machines which perform work on the mold. The walking beam conveyor is close to these work stations. Therefore, a certain amount of sand drops from the mold as it is transferred into or out of these work stations by the walking beam conveyor system of the present invention.

The walking beams of the conveyor system of the present invention are supported on rollers which are capable of moving in a substantially vertical direction so that the mold can be lifted from or placed on the support beam. An air-hydraulic cylinder is provided for moving the walking beam in a horizontal direction. As the walking beam moves in a horizontal direction, the mold is moved along a path to or from the work station on which certain operations are taking place in the mold.

Generally, roller conveyors are problematic since the sand dropping from the mold damages the bearings requiring frequent replacement of the rollers. The present invention eliminates this problem. The rollers which support the walking beam are few in number, relatively spaced from the work station and are capable of a design which allows the sand to be shielded therefrom.

In transferring the mold from the first walking beam conveyor to the shuttle conveyor and also in transferring the mold from the shuttle conveyor to the second conveyor, no additional devices are needed.

The novel conveyor transfer system of the present invention provides a corner transfer device which minimizes the use of high cost piston-cylinder units and motors and their associated systems by decreasing the number of units or motors required and the sizes of those units over that required by known transfer systems. It should be clearly understood, for example, normal piston-cylinder units are expensive since they must be of substantial size to move a mold due to the substantial weight of a mold. Accordingly, the conveyor transfer system of the present invention provides a corner transfer device for a mold at a lower cost than those provided by the known art.

The novel conveyor transfer system of the present invention also minimizes the wear on the mold being transferred and avoids "peening" of the sides of the mold or wear on the bottom. This objective is achieved since the "walking" beam lifts up the article, moves the article along its path and places the article down in its new location. The conveyor transfer system of the present invention also requires less space than those required by the known systems.

The novel conveyor transfer system of the present invention also provides for ready synchronization of the transfer of the article from the first to the second conveyor. To provide such synchronization, sensing means are provided to detect when the walking beams of the first conveyor places a mold on the first portion of the shuttle conveyor. This sensing means activates the transfer means of the shuttle conveyor so that the mold is transferred from the first portion to the second portion of the shuttle conveyor. Once the mold is in position on the second portion of the shuttle conveyor, the walking beams of the second conveyor pick up the mold from the second portion and begin to move it along the second article-travel-path of the second conveyor. Thus, after activating the transfer means of the shuttle conveyor, the article is properly positioned to be transferred to the second conveyor and synchronization between the first and second conveyors is not a critical matter.

BRIEF DESCRIPTION OF THE DRAWINGS

A more complete understanding of the invention can be had from the following drawings and specification.

In the drawings.

DESCRIPTION OF THE ILLUSTRATED EMBODIMENT

Figure 1:
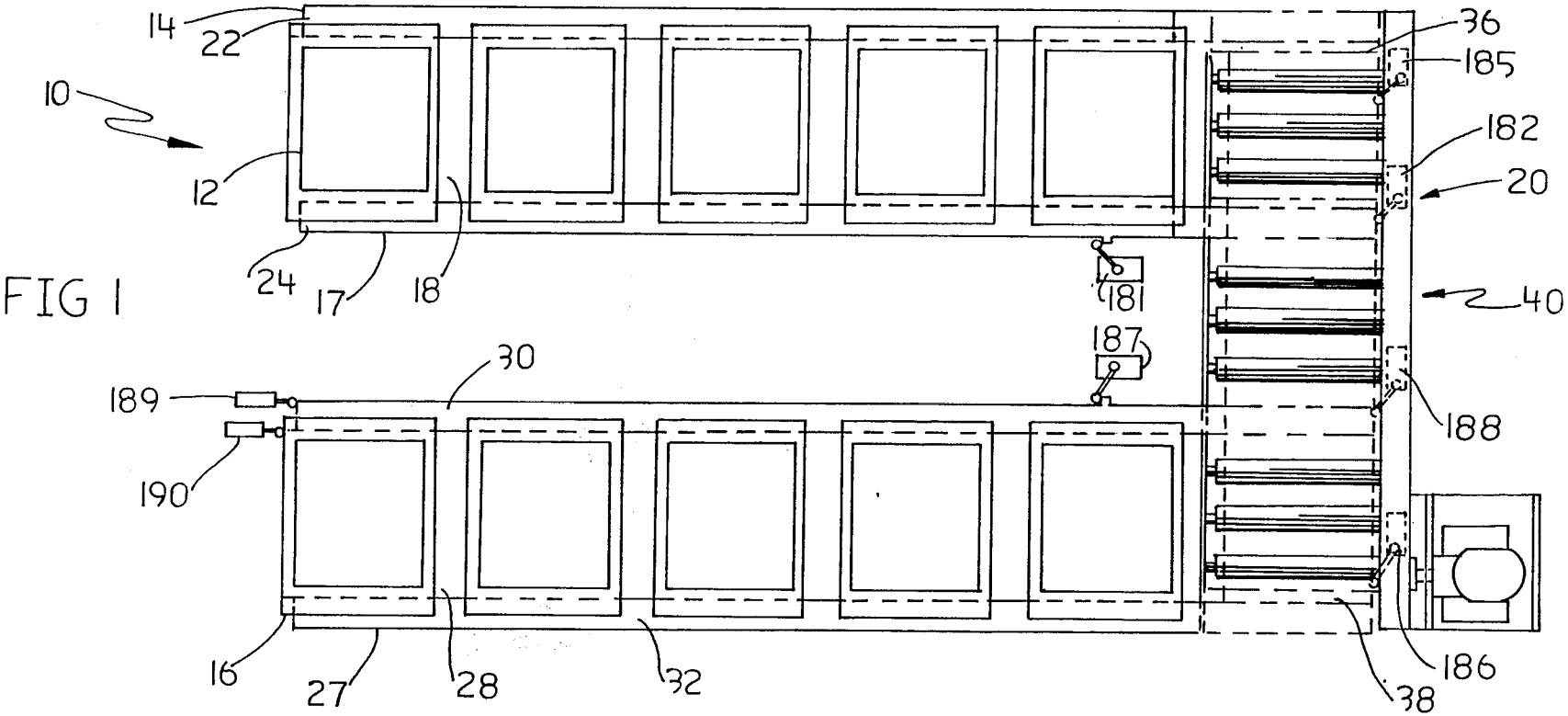
FIG. 1 is a schematic plan view of one conveyor transfer system made in accordance for the principles of this invention.

The present invention provides a conveyor transfer system for use in a foundry to transfer an article between a first and second article-travel-paths. The conveyor transfer system of the present invention provides the advantageous features which permit the transfer of an article from one conveyor to another at a minimum of cost, wear on the article, space required by the system and allows for ready synchronization of the transfer of the article from one conveyor to another. The present invention may be applied to conveyor transfer systems of a wide variety of constructions and designs and for purposes of illustration is described in the drawings as applied in a foundry to a conveyor transfer system 10 for transferring a mold 12 between first and second article-travel-paths 14, 16 respectively, as shown in FIG. 1.

Figure 2:
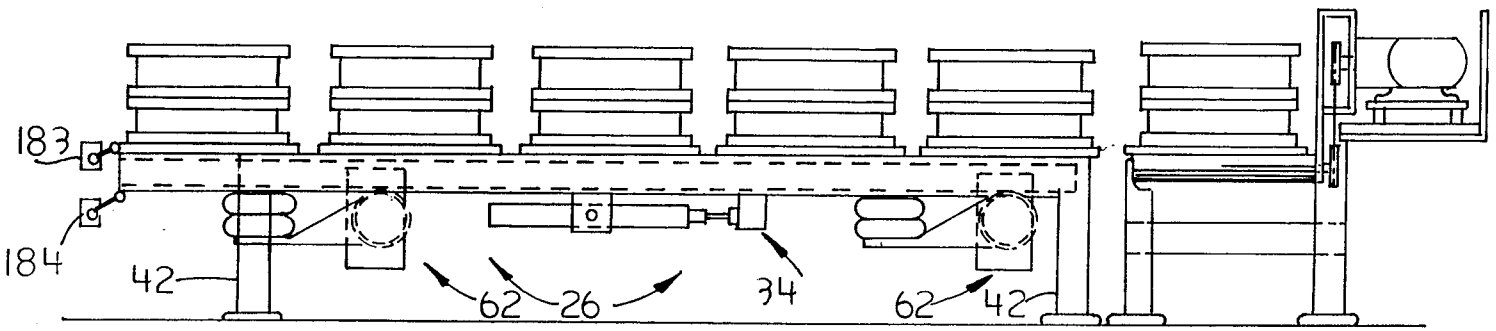
FIG. 2 is a side elevational view of the conveyor transfer system shown in FIG. 1 and showing an apparatus for moving articles along a conveyor.

The conveyor transfer system 10, shown in FIGS. 1 and 2, has a first conveyor 17 for moving the molds 12 along the first article-travel-path. The first conveyor 17 has one end positioned adjacent to a work station (not shown). The first conveyor receives the molds 12 from the work station and transports them along the first article-travel-path 14 to the shuttle conveyor 20 as will be hereinafter more fully described.

The first conveyor 17 has centrally located support beams 18 for supporting the molds 12 thereon. The support beams 18 extend along the first article-travel-path 14 and have one end positioned adjacent to the shuttle conveyor 20 of the conveyor transfer system 10. The other end of the support beams 18 are positioned adjacent to the work station to which the conveyor 17 is adjacent. The first conveyor 17 transports the molds 12 from the work station to the shuttle conveyor 20.

In order to so move the molds 12 along the first article-travel-path 14, the first conveyor 17 includes movable beams 22, 24 located on both sides of the support beams 18 and extending therealong. Means, generally indicated at 26 in FIG. 2, are provided for moving the movable beams 22, 24 in a vertical direction to lift the molds 12 from the support beams 18. The moving means 26 is also capable of moving the movable beams 22, 24 in a horizontal direction so that the article supported on the movable beams is moved along the support beams 18 to a new position. The moving means 26 is also capable of lowering the movable beams 22, 24 in a vertical direction so that the molds 12 are supported by the support beams 18 and no longer supported by the movable beams. The moving means 26 then provides for returning the movable beams 22, 24 to their original position so that the above-described cycle can be repeated. Accordingly, the molds are "walked" along the first article-travel-path 14.

The conveyor transfer system 10 of the present invention also provides a second conveyor 27 for moving the molds 12 along the first article-travel-path. The second conveyor 27 has one end positioned adjacent to a second work station (not shown) and the other end adjacent to the shuttle conveyor 20. It should be understood that it is within the contemplation of this invention that the work stations may also be positioned at any place along the conveyor transfer system 10 or associated transfer devices.

The second conveyor receives the molds 12 from the shuttle conveyor 20 and transports them along the second article-travel-path 16 to the second work station as will be hereinafter more fully described. The second conveyor 27 has centrally located support beams 28 for supporting the molds 12 thereon. The support beams 28 extend along the second article-travel-path 16 and have one end positioned adjacent to the shuttle conveyor 20 of the conveyor transfer system 10. The other end of the support beams 28 are positioned adjacent to the second work station to which the conveyor 27 is adjacent.

In order to so move the molds 12 along the second article-travel-path 16, the second conveyor 27 includes movable beams 30, 32 located on both sides of the support beams 28 and extending therealong. Means, generally indicated at 26 in FIG. 2, are provided for moving the movable beams 30, 32 in a vertical direction to lift the molds 12 from the support beams 28. The moving means 26 includes the vertical moving means 62 capable of moving the movable beams 30, 32 in a horizontal direction so that the article supported on the movable beams are moved along the support beams 28 to a new position. The moving means 62 is also capable of lowering the movable beams 30, 32 in a vertical direction so that the molds 12 are supported by the support beams 28 and no longer supported by the movable beams. The moving means 26 also includes a horizontal moving means 34 which provides for returning the the movable beams 30, 32 to their original position so that the above-described cycle can be repeated. Accordingly, the molds are "walked" along the second article-travel-path 14.

The conveyor transfer system 10 also includes a shuttle conveyor for transporting the molds 12 between the first and second conveyors 17, 27 respectively. The shuttle conveyor 20 has a first portion, generally indicated at 36, which is positioned in alignment with the first article-travel-path 14 and adjacent to the first conveyor 17. The shuttle conveyor 20 also has a second portion 38 positioned in alignment with the second article-travel-path 16 and forming a continuation thereof. The second portion 38 of the shuttle conveyor 20 is positioned adjacent to one of the ends of the second conveyor 27. The shuttle conveyor also has transfer means 40 for transferring the molds 12 from the first portion 36 to the second portion 38.

As can be seen from the above, the molds 12 which travel along the first article-travel-path 14 are changed in their direction of movement along the second article-travel-path 16 in a manner which achieves the advantageous features of the present invention.

The first and second conveyors 17, 27 respectively, are similar in construction and design and for ease of description, only the first conveyor 17 will be hereinafter described in detail.

Figures 3, 4:
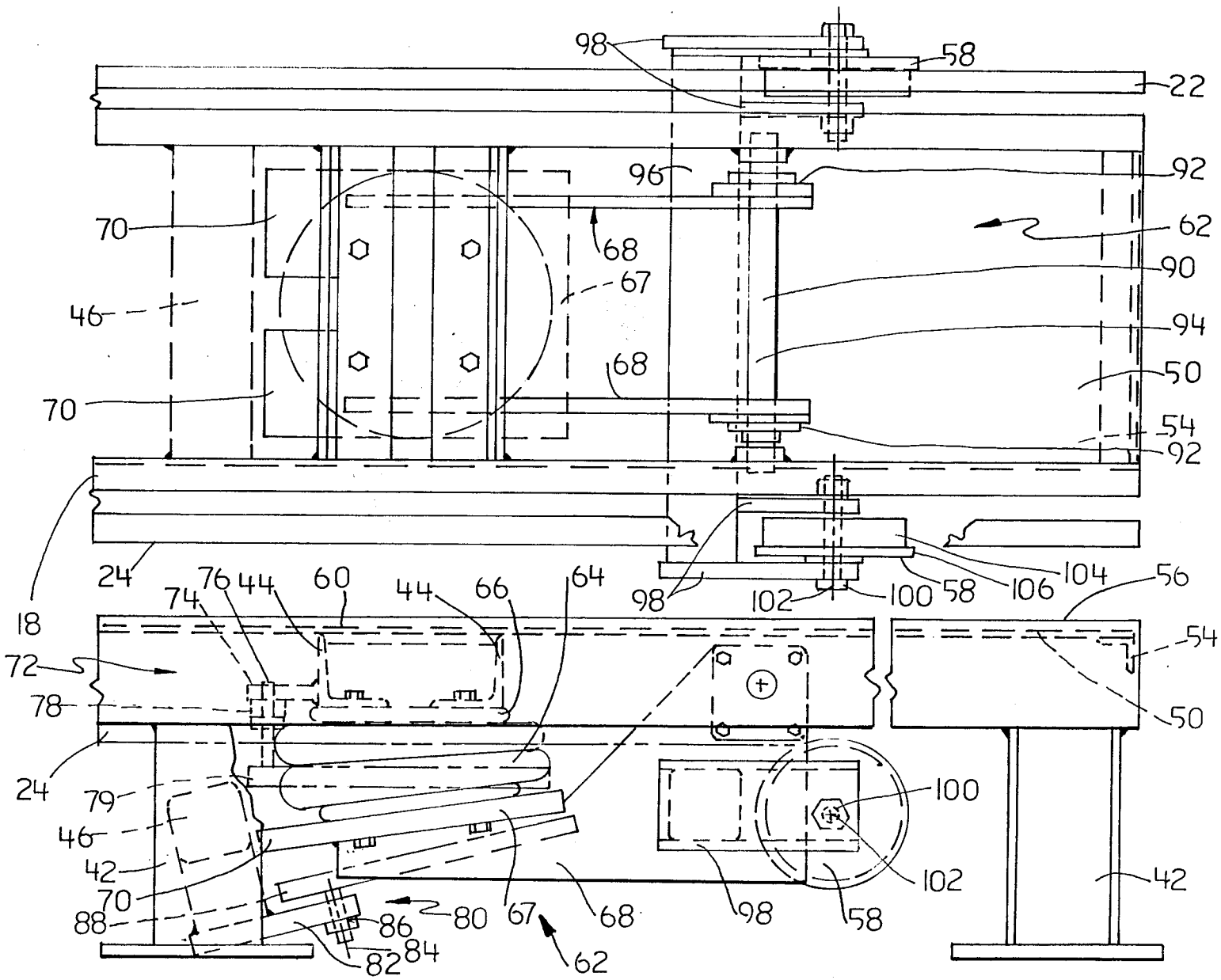
FIG. 3 is an expanded top view of a portion of the moving apparatus shown in FIG. 2.
FIG. 4 is an expanded side elevational view of a portion of the moving apparatus shown in FIG. 2.

As described hereinabove, the first conveyor 17 "walks" the molds 12 along the first article-travel-path 14. The first conveyor 17 includes a base 42, as seen in FIG. 2, which rests on the floor of the facility in which the system 10 is located. The base 42 is secured to the support beams 18 by any known conventional means, such as welding, as seen in FIG. 4. The support beams 18 are spaced from each other a sufficient distance to support the molds 12 but are still positioned close enough together so that the movable beams 22, 24 are positioned beneath the outer peripheral edge surfaces of the bottoms of the molds 12. This distance between the support beams 18 is determined and maintained by a series of cross members 44, 46 and 48 extending across the support beams 18 and extending between the base members 42, as particularly seen in FIGS. 4 and 6. It should be understood that the cross members 44, 46 and 48 are typical and that throughout the length of the first conveyor 17, any number of other cross members may be provided as required.

Figure 5:
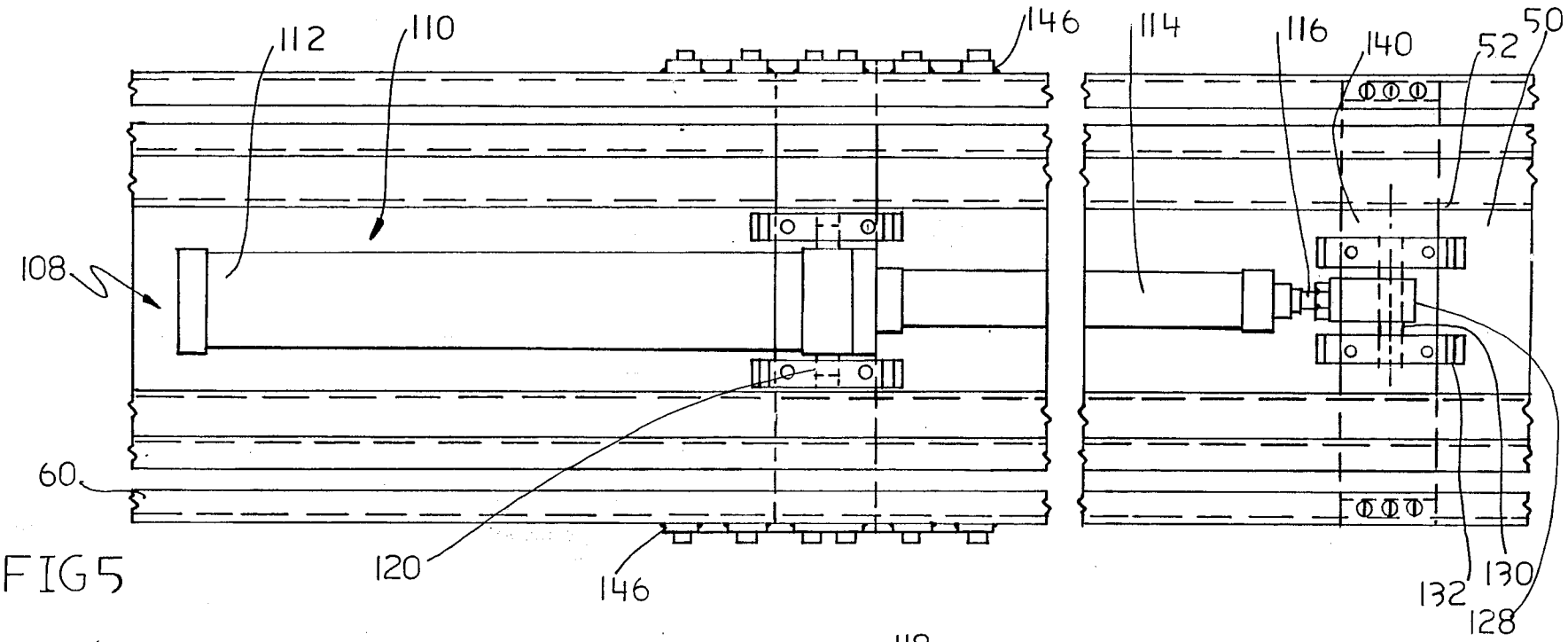
FIG. 5 is an expanded view of another portion of the moving apparatus shown in FIG. 2.

In order to shield the operative components positioned between the support beams 18, a shield plate 50 is provided, as seen in FIGS. 3, 4 and 5. The shield plate 50 is positioned slightly below the mold support surface 56 of the support beams 18 on the inner sides thereof and along the length of the support beams. The shield plate 50 is supported by the side supports or side angle members 52 which are secured to each of the support beams 18 on the inner sides thereof, as seen in FIG. 5. The cross supports or cross angles 54, as seen in FIGS. 3 and 4, are provided to further support the shield plate 50. The cross supports 54 are secured to the support beams 18. It should be understood that any number of cross supports 54 may be provided so that the shield plate 50 is properly supported throughout its entire length.

In order to "walk" the molds along the support beams 18, the movable beams 22, 24 are provided and are positioned outboard of the support beams and adjacent thereto, as seen in FIGS. 3 and 4. The movable beams 22, 24 are positioned and supported by the rollers 58 of the moving means 26. As described above, the means 26 for moving the movable beams 22, 24 provides for raising the movable beams so that the top or mold support surface 60 of the movable beams comes into contact with the bottom of the molds and accordingly, raises the molds above the mold support surface 56 of the support beams 22, 24 so that the molds 12 supported thereon are places on the support beams 18 and are supported thereby. To perform this function, the means 26 lowers the mold support surface 60 of the movable beams 22, 24 from a position above the mold support surface 56 of the support beams 18 to a position below the mold support surface 56 of the support beams.

The means 26 includes a raising and lowering means, generally indicated at 62 in FIGS. 3 and 4. The raising and lowering means 62 includes an air bellows or air ride 64 which has one side thereof supported by the pad 66 secured to the cross members 44 extending between the support beams 18. The other side of the air bellows 64 is supported by the lower support pad 67 which is secured to the pivot arms 68.

The lower support pad 67 has outwardly extending lips 70 thereon which serve to adjustably limit the travel of the air bellows 64. The upper stops, generally indicated at 72, are provided to limit the upper travel of the air bellows 64 and include extension members 74 fixed to the base 42. The upper stops also include a threaded fastener 76 threadedly received in an opening in the extension member 74. Thus, when the threaded fastener 76 is rotated, the bottom of the threaded fastener can adjustably limit the upward movement of the lower pad 67. A nut 78 is provided to secure the position of the threaded fastener 76 once the desired upper position 79 of the air bellows 64 is determined.

The extension members 74 are positioned so that the threaded fastener 76 contacts the outwardly extending lips 70 of the lower pad 67 and do not contact the air bellows 64 which would, of course, damage the air bellows since the air bellows are made of a flexible material. To provide for equilibrium in the stopping forces, two upper stops 72 are provided over each of the lips 70, seen in FIG. 3. Accordingly, the upper position of the lower pad 67 as indicated by the phantom lines 79 is adjustably limited by the upper stop 72.

In order to adjustably limit the lower position 88 of the air bellows 64, the lower stop 80 is provided. As seen in FIG. 4, the lower stop 80 includes an extension member 82 secured to the cross member 46. The extension member 82 threadedly engages the threaded fastener 84. The threaded fasteners 84 are positioned so that they contact the bottom of the lower pad 67. When the threaded fasteners 84 are rotated, the lower position 88 of the lower pad 67 may be adjusted and accordingly, the lower position of the air bellows 64, indicated at 88, may be adjusted. Once the lower position 88 is properly adjusted, the nut 86 is provided on the threaded fastener 84 to lock the threaded fastener 84 in the desired position.

To transfer the raising and lowering motion of the air bellows 64 to the rollers 58 which support the movable beams 22, 24, the pivot arms 68 are secured to the support beams 18 by means of the pivot shaft 90 and bearings 92. The bearings 92 are secured to the pivot arms 68 and rotate about the pivot shaft 90 extending between the support beams. The pivot arms 68 rotate about the axis 94 of the pivot shaft.

To secure the rollers 58 to the pivot arms 68, a pivot cross member 96 is provided and is secured to the pivot arms 68. The roller support arms 98 are secured to the pivot cross member 96. Two roller support arms 98 are provided for each roller 58 and are spaced a sufficient distance so that a roller 58 can be positioned therebetween. The roller support arms 98 are laterally positioned so that when a roller 58 is positioned therebetween, the movable beams 22, 24 supported thereby are properly laterally positioned, as herein described. The roller support arms have openings therethrough for receiving a roller pivot shaft 100 therein along a predetermined roller pivot axis 102. The roller pivot axis 102 is positioned a sufficient horizontal distance away from the pivot shaft axis 94 so that when the pivot arms 68 are rotated by means of the air bellows 64, sufficient vertical movement is provided to raise the molds 12 from the support beams 18 or lower the molds 12 onto the support beams 18. The rollers 58 have openings therethrough adapted to receive the roller pivot shaft 100 therein so that the rollers are freely rotatable with respect to the roller support arms 98.

As hereinabove stated, the movable beams 22, 24 are positioned adjacent to the support beams 18 so that they may support the molds 12 thereon when they are moved to a raised position. In order to further maintain this lateral positioning of the movable beams 22, 24, the roller 58 includes a support portion 104 for supporting the movable beams 22, 24 thereon, and a flange portion 106 for minimizing any lateral movement of the beam as it moves along the first article-travel-path 14.

As can be seen from the above, when the air bellows 64 is in the upper position 79, the rollers 58 are in a lowered position so that the mold support surface 60 thereof is below the mold support surface 56 of the support beams 18. As further described above, this position is adjustable. When it is desired to raise the mold support surface 60, pressurized air is introduced into the air bellows 64 so that the air bellows expand and move the lower pad 67 to its lower position 88. When the lower pad 67 is so moved, the rollers 58 are raised. Consequently, the movable beams 22, 24 are raised so that the mold support surface 60 of the movable beams rises above the mold support surface 56 of the support beams 18 so that the molds are supported on the movable beams 22, 24. In this position, the movable beams 22, 24 and consequently the molds 12 are movable in a lateral position along the first article-travel-path 14.

Conversely, to lower the movable beams 22, 24, the source of pressurized air is removed from the air bellows 64. The weight of the movable beams 22, 24 and molds 12 operate to lower the movable beams so that the molds are supported on the support beams 18 and the mold support surface 60 of the movable beams 22, 24 is no longer in contact with the molds 12. In this position, the movable beams 22, 24 are movable in a lateral position and are supported on the rollers 58 with the air bellows 64 in the upper position 79.

Dependent on the vertical loads that must be carried by the movable beams 22, 24, a number of different raising and lowering means 62 may be provided, as seen in FIG. 2. The movement of these raising and lowering means 62 are coordinated by an equalizing manifold means or separate valves which supply equal amounts of pressurized air to each of the air bellows 64 of each of the raising and lowering means 62.

It should be understood that it is within the contemplation of the present invention to provide other means for raising and lowering the movable beams 22, 24 which also allow for free lateral movement of the movable beams in either the raised or lowered position.

Figure 6:
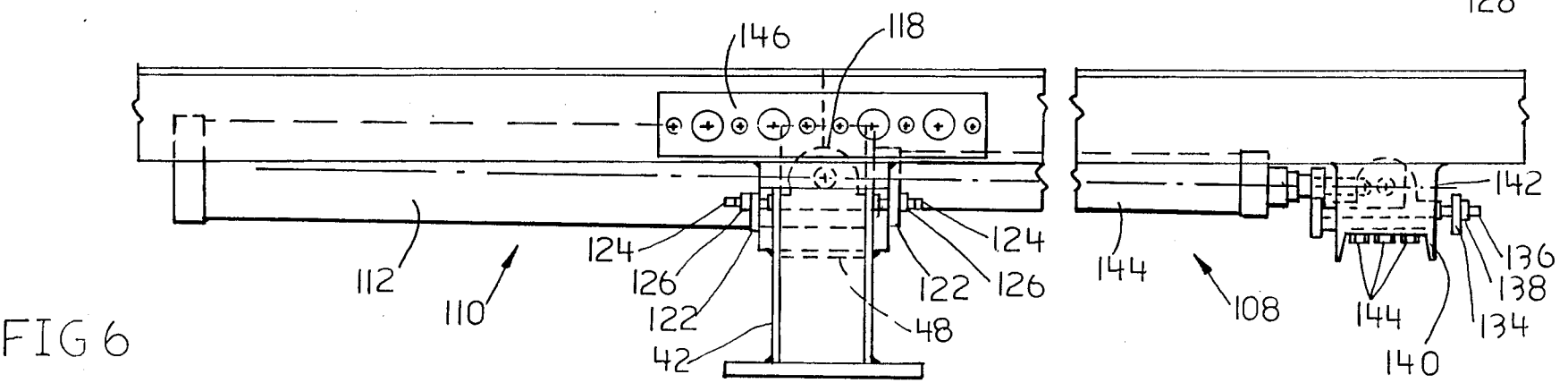
FIG. 6 is an expanded side elevational view of the other portion of the moving apparatus shown in FIG. 5.

In order to laterally move the movable beams 22, 24 along the first article-travel-path 14, the moving means 26 includes lateral moving means 108. The lateral moving means 108 includes an air-hydraulic cylinder 110 as seen in FIGS. 5 and 6. The air-hydraulic cylinder 110 may be of any commercially available design and generally has an air piston-cylinder portion 112 and a hydraulic piston-cylinder portion 114. A movable piston shaft 116 extends from the hydraulic piston-cylinder portion 114. The air-hydraulic cylinder described herein is provided to supply a smooth, even movement of the movable beams 22, 24 which is relatively unaffected by surges in the air pressure supplied thereto. In general operation, pressurized air is supplied to the air piston-cylinder portion 112 which moves the hydraulic piston-cylinder portion 114. Due to the relatively minimal compressibility of the fluid in the hydraulic piston-cylinder portion, the motion of the movable piston shaft 116 is relatively smooth. The operation of the air-hydraulic cylinder 110 is well known to those skilled in the art and as is known when pressurized air is supplied to one side of the air piston-cylinder portion 112, the movable piston shaft 116 will move in one direction and when pressurized air is supplied to the other side of the air piston-cylinder portion 112, the movable piston shaft 116 moves in the opposite direction.

In order to move the movable beams 22, 24 in a lateral direction, the air piston-cylinder 112 is secured to the base 42 and the movable piston shaft 116 is secured to the movable beams 22, 24.

To secure the air piston-cylinder portion to the base 42, a pair of bearings 118 are provided and are adjustably secured to the cross member 48. The cross member 48 extends between two upright portions of the base 42, as seen in FIGS. 5 and 6. A cylinder support pivot 120 is received in the bearings 118 so that the air piston-cylinder portion 112 is rotatably supported by the bearings 118. As seen in FIG. 6, extensions 122 are secured to the cross member 44 and have threaded openings for receiving the threaded fasteners 124 therein. By adjustment of the threaded fasteners, the bearings 118 can be moved in a lateral direction to adjust the lateral position of the air-hydraulic cylinder 110 and consequently the lateral position of the movable beams 22, 24. Lock nuts 126 are provided to lock the threaded fasteners 124 in position once the proper lateral position of the air-hydraulic cylinder 110 is achieved.

In order to secure the movable piston shaft 116 of the air-hydraulic cylinder 110 to the movable beams 22, 24, a pivot member 128 is adjustably secured to the end of the movable piston shaft 116. Such an adjustable securement may be achieved by threading the end of the movable piston shaft 116 with complimentary threads in the piston pivot member 128 as is known. A piston drive shaft 130 is rotatably received in an opening in the piston pivot member 128 and is supported by bearings 132 adjustably secured to the cross member 140. The adjustable securement is provided by securing extension members 134 to the cross member 140. The extensions 134 have threaded openings therein for receiving the threaded fasteners 136. The threaded fasteners can be adjusted to laterally position and adjust the cross member 140 with respect to the piston drive shaft 130. Lock nuts 138 are provided for locking the threaded fasteners 136 in position once a final adjustment is achieved.

The cross member 140 extends across the first conveyor 17 and is positioned beneath the movable beams 22, 24. Upper extensions are secured to the bottom of the movable beams 22, 24 and are fastened to the cross member 140 by means of fasteners 144. Thus, when the movable beams 22, 24 are raised, the cross member 140 clears the support beams 18. As can be seen from the above, the air-hydraulic cylinder 110 provides for movement in a lateral direction to simultaneously move both of the movable beams 22, 24 in either lateral direction.

In some cases, it is necessary to provide a rather long first conveyor 17. In such cases, the movable beams 22, 24 are not commercially available and two beams must be spliced together. As shown in FIGS. 5 and 6, such a splice is achieved by a gusset plate 146 attached to the ends of the beams to be joined and secured thereto by means of a combination of threaded fasteners and welding.

The length of the movable beams is dependent on the particular functions required of the first conveyor. If it is desirable for the movable beams to pick up a mold from a work station, the movable beams must be of sufficient length to reach into the work station, lift up the mold being transferred to the first conveyor, move that mold to a position above the support beams 18 and lower the mold into place. If, on the other hand, the work station has means for transferring the mold to the first conveyor, the movable beams 22, 24 need not have such additional length but merely be capable of lifting the mold 12 in the first position on the first conveyor 17.

In order to transfer the mold closest to the shuttle conveyor 20, it is necessary for the movable beams 22, 24 to have sufficient length so that they extend across the first portion 36 of the shuttle conveyor and place the mold to be transferred to the shuttle conveyor on the first portion 36 thereof. On the other hand, the movable beams 30, 32 of the second conveyor 27 must have sufficient length to extend across and receive the mold from the second portion 38 of the shuttle conveyor 20 and move that mold onto the second conveyor and subsequently along the second article-travel-path 16.

Figures 7, 8:
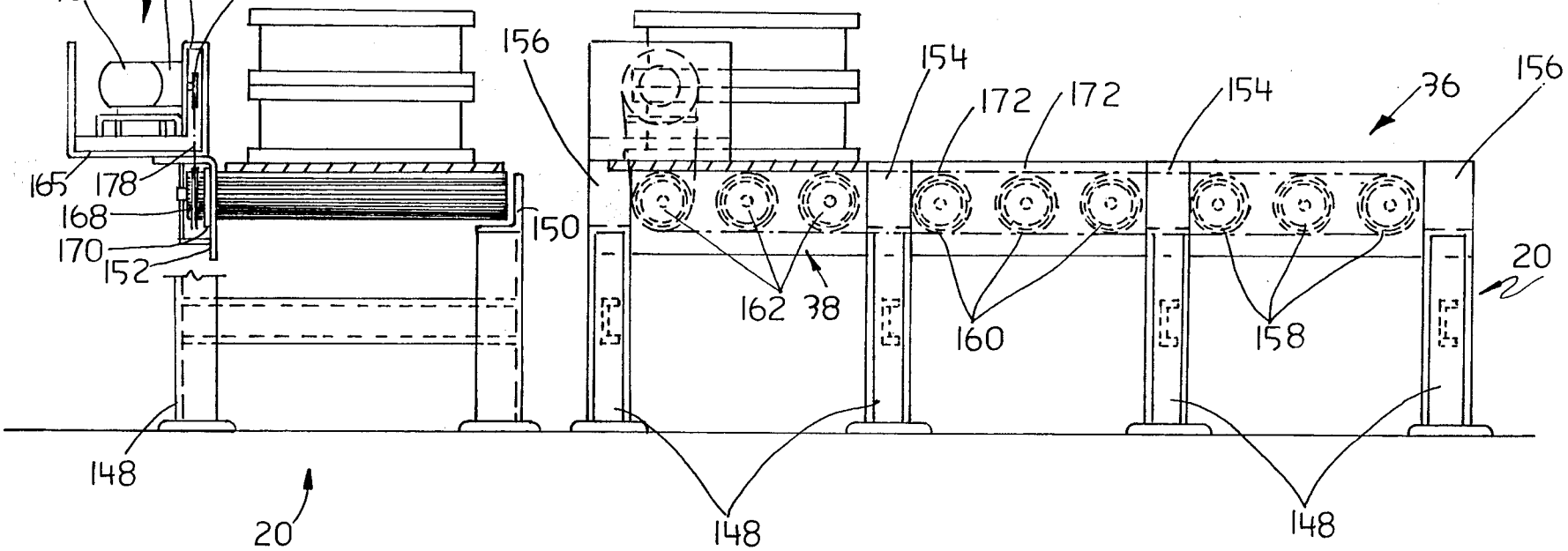
FIG. 7 is a partial side elevational view of the shuttle conveyor shown in FIG. 1.
FIG. 8 is an expanded side elevational view of the shuttle conveyor shown in FIG. 7.

The shuttle conveyor 20, as seen in FIGS. 7 and 8, includes a base, generally indicated at 148, for supporting the shuttle conveyor 20. The shuttle conveyor 20 also has inner and outer opposed members 150, 152 respectively. The inner channel is located in a position adjacent to the first and second conveyors 17, 27 respectively, and has cutouts 154, 156 for receiving the movable beams 22, 24, 30, 32 of the respective conveyor 17, 27 positioned adjacent thereto, as will be hereinafter more fully described. Of course, it should be understood that other configurations of the present invention may require cutouts in the outer channel 152, for example, if the second conveyor goes in the opposite direction of that shown in FIG. 1. The inner and outer channels 150, 152 are secured to the base 148. By using the movable beams 22, 24, 30, 32 to place the mold 12 on or remove the mold 12 from the shuttle conveyor 20, other expensive and complicated transfer equipment and apparatuses are avoided.

The shuttle conveyor 20 includes a series of rollers 158, 160 and 162 each of which are rotatably supported by the members 150, 152 on their ends. The tops of the rollers 158, 160 and 162 coplanar with the mold support surface 56 of the support beams 18 of the first conveyor 17 and the corresponding mold support surface of the support beams of the second conveyor 27.

The first portion 36 of the shuttle conveyor 20 is defined by the rollers 158. The transfer portion of the conveyor is defined by the transfer rollers 160. The second portion 38 of the shuttle conveyor is described by the rollers 162. The rollers 158, 160 and 162 support the mold 12 as it is transferred from the first portion 36 to the second portion 38 of the shuttle conveyor 20.

The shuttle conveyor 20 includes transfer means 40 for transferring a mold from the first portion 36 to the second portion 38 thereof. The transfer means 40 includes a motor 164 which is secured to a support 165 attached to the member 152. The motor 164 is provided to rotate the rollers 158, 160 and 162. Each of the rollers 158, 160 and 162 includes two sprockets 168, 170 connected to one end portion thereof. Each roller is connected with the adjacent roller by a chain 172. The sprockets 168, 170 and chains 172 are completely enclosed in a housing 174 which keeps them free of sand and debris.

The motor 164, as shown in FIG. 7, is connected with the rollers 162 of the shuttle conveyor 20. The motor 164 includes a speed reducer 165 and a drive sprocket 176 which drives a chain 178. The chain 178 engages one of the sprockets on ooe of the rollers 162. Thus, when the motor 164 is activated, power is transmitted through the chains 178, 172 to drive the rollers 158, 160 and 162. When the rollers 158, 160 and 162 rotate, they move the mold supported thereon between the ends of the shuttle conveyor 20.

Figure 9:
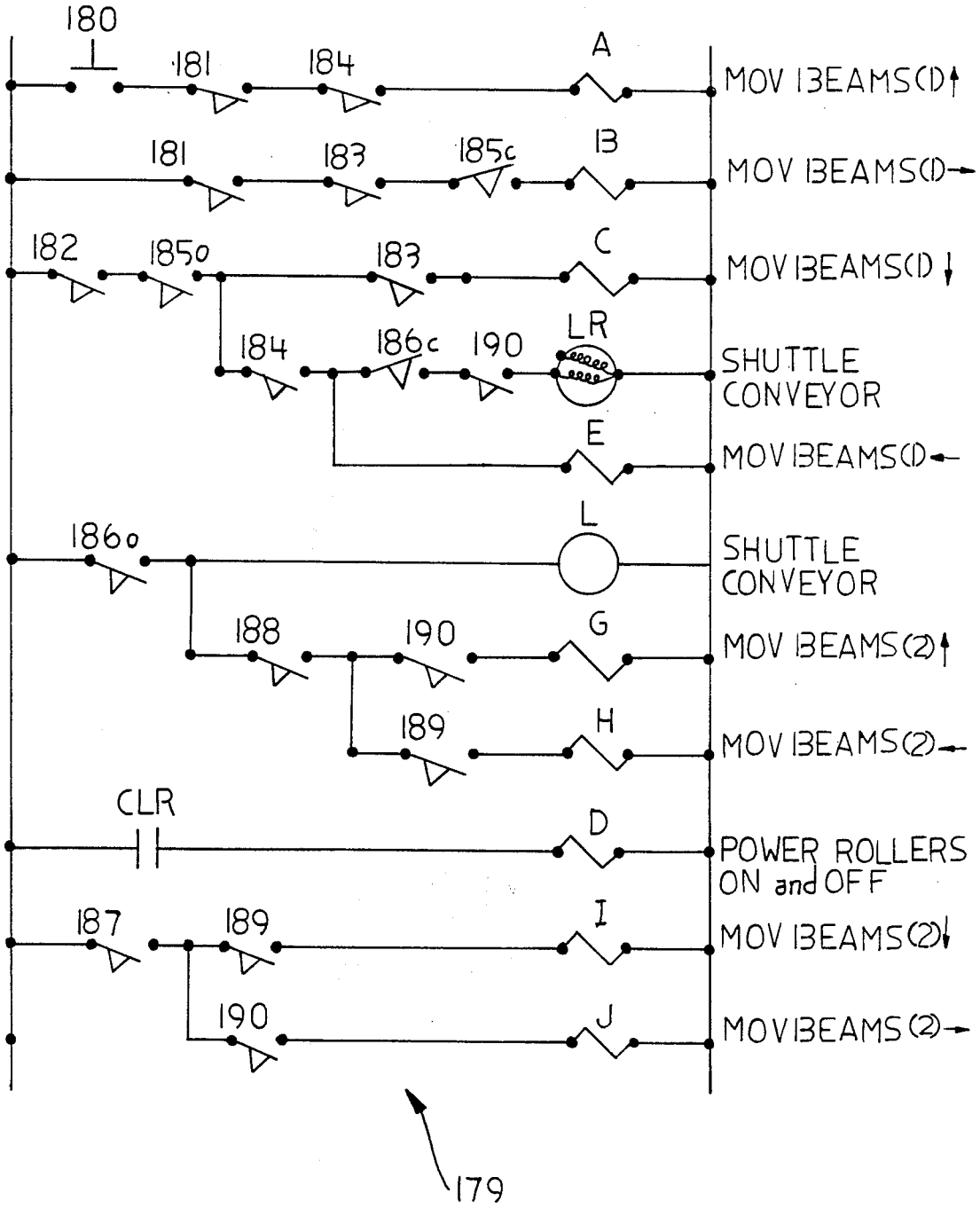
FIG. 9 is a schematic diagram of the controls and associated circuitry for the conveyor transfer system shown in FIG. 1.

The present invention also provides an automatic control means schematically indicated at 179 in FIG. 9. The automatic control means 179 provides for automatically controlling the movement of the movable beams 22, 24, 30, 32 and the shuttle conveyor 20. For ease of description, the limit switches and solenoid valves are schematically indicated in FIG. 9. The specific locations of the limit switches are shown in FIGS. 1 and 2 and will be more specifically herein described in connection with the automatic operation of the conveyor system 10 of the present invention.

As seen in FIG. 1, a limit switch 181 is provided which senses when the movable beams 22, 24 of the first conveyor 17 are in a retracted position. When the beams 22, 24 are in a retracted position, a limit switch 181 is in a closed position and when the movable beams 22, 24 advance, the limit switch 181 opens. The limit switch 182 is provided and is mounted on the shuttle conveyor 20. The limit switch 182 is normally open and when the movable beams 22, 24 advance through the cutout 154 until the mold 12 is positioned above the rollers 158 of the first portion 36, the limit switch 182 is closed. The limit switch 183 is provided as seen in FIG. 2 and is in a normally open position. When the movable beams 22, 24 move to a raised position so that the molds 12 are supported thereon, the limit switch 183 is closed. When the beams 22, 24 are lowered, the limit switch 183 moves to an open position. A limit switch 184 is also provided to sense when the movable beams 22, 24 are in a lowered position. When the movable beams 22, 24 are in a lowered position, a switch 184 is closed and when they are raised from the lowered position, the limit switch 184 moves to an open position.

The limit switch 185 is also provided and has two sets of contacts, one set being normally open (designated by the subscript "o") and the other being normally closed (designated by the subscript "c"). The limit switch 185 is activated when a mold 12 is positioned on the rollers 158 of the first portion 36 of the shuttle conveyor 20. The limit switch 186 is also provided and has two sets of contacts, one set being normally open (designated by the subscript "o") and the other set being normally closed (designated by the subscript "c"). The limit switch 186 moves from its normal position when a mold 12 is positioned on the rollers 162 of the second portion 38 of the shuttle conveyor 20. The normally open limit switch 187 is provided to sense when the movable beams 30, 32 are in a retracted position and not in an extended position towards the shuttle conveyor 20. The limit switch 188 is provided to sense when the movable beams 30, 32 are in an extended position with respect to the shuttle conveyor 20 and when they are so extended, limit switch 188 is closed. The limit switches 189 and 190 are also provided to sense the raised or lowered position of the movable beams 30, 32 of the second conveyor 27. Limit switches 189, 190 operate similar in function to the limit switches 183, 184 respectively, described above.

FIG. 9 shows a schematic representation of the interconnection of limit switches 181 through 190 and other electrical components connected thereto which operate to automatically advance molds through the conveyor system 10 while assuring a jamming of the machine will be minimized. For ease of description, the actual mechanical function performed by each step of the schematic diagram is indicated on the righthand side with the movable beams 22, 24 of the first conveyor 17 indicated by movable beams (1) and the movable beams 30, 32 of the second conveyor 27 indicated by movable beams (2).

In order to begin operation of the automatic control means 179, a pushbutton switch 180 is manually activated by an operator. Of course, it should be understood that the pushbutton 180 may be replaced with a limit switch which senses a movement at one of the work stations which indicates that the work is completed on the mold at that work station and the mold is ready to be transferred. When the pushbutton switch 180 is depressed or is activated, and the movable beams 22, 24 are in the lowered retracted position, a solenoid valve A is activated. The solenoid valve A, when activated, connects a source of pressurized air to the air bellows 64 of the first conveyor 17 which raises the movable beams. When the movable beams reach the raised position, the limit switch 183 is closed. The limit switch 185 is connected across the normally closed contacts which indicates that a mold 12 is not located on the first portion 36 of the shuttle conveyor 20. Accordingly, the solenoid valve B is activated. The solenoid valve B supplies pressurized air to the air-hydraulic cylinder 110 so that the movable beams are advanced towards the shuttle conveyor. When the movable beams 22, 24 are advanced, the mold 12 supported thereon is moved toward the shuttle conveyor. This movement continues until the movable beams 22, 24 are positioned above the first portion 36 of the shuttle conveyor 20.

When the mold to be transferred is properly positioned above the first portion 36 of the shuttle conveyor 20, limit switch 182 is closed by one of the movable beams 22, 24 and the normally open contacts of the limit switch 185 are closed by the presence of a mold, limit switch 183 is still in a normally closed position since the movable beams are raised and accordingly, the solenoid valve C is activated. The solenoid valve C deactivates the solenoid valve A and vents the pressurized air in the air bellows 64 of the first conveyor 17 so that the movable beams lower and consequently the mold supported thereon is lowered onto the rollers 158.

It should be also understood that a series of molds are so advanced along the first conveyor as these series of functions occur. When the movable beams 22, 24 reach their lower position, limit switch 184 is closed. Since the limit switches 182 and 185 are already closed, solenoid valve E is activated which supplies pressurized air to the air-hydraulic cylinder 110 in a manner that retracts the movable beams 22, 24 to their original retracted position. As the movable beams so move, they roll along the rollers 58, as hereinabove described. Also, when limit switches 182, 185 and 184 are closed, if limit switch **186*c* is closed, which indicates that no mold is in the second portion 38 of the shuttle conveyor 20 and limit switch 190 is closed, which indicates that the movable beams 30, 32 of the second conveyor 27 are in a lowered position, the latch relay LR closes the closing latch relay CLR, closes and holds closed the closing latch relay CLR. The CLR energizes a motor starter coil D which drives the motor 164 of the shuttle conveyor 20. When the shuttle conveyor 20 is so activated, the rollers 158, 160 and 162 are rotated to move the mold from the first portion 36 to the second portion 38 of the shuttle conveyor 20**.

When the mold reaches the second portion 38 of the shuttle conveyor 20, limit switch **186*o* is closed which activates L which opens CLR to deenergize the motor starter coil D consequently stopping rotation of the motor 164 and movement of the mold on the shuttle conveyor 20. In this position, the movable beams 30, 32 of the second conveyor 27 are in an extended position and are positioned underneath the mold on the second portion 38. Accordingly, the limit switch 188 is in a closed position and the limit switches 188 and 190 are in a closed position which activates the solenoid valve G which supplies pressurized air to the air bellows on the second conveyor 27 to raise the movable beams 30, 32. Thus, the mold on the second portion 38 of the shuttle conveyor 20 is lifted off of the rollers 162. When the movable beams 30, 32 reach their raised position, limit switch 189 is closed which activates solenoid valve H. Solenoid valve H is connected to the air-hydraulic cylinder of the second conveyor 27 so that the mold supported by the beams 30, 32 over the second portion 38 is moved towards the second conveyor 27**.

When the movable beams 30, 32 reach their fully retracted position and the molds are positioned over the support beams 28 of the second conveyor 27 and the movable beams 30, 32 are in a raised position, the solenoid valve I is activated. The solenoid valve I releases the pressurized air from the air bellows of the second conveyor 27 so that the molds 12 supported by the beams 30, 32 are placed on the support beams 28 of the second conveyor. When the beams 30, 32 reach their lowered position, limit switch 190 is closed to activate solenoid valve J. The solenoid valve J is connected to the air-hydraulic cylinder of the second conveyor 27 so that the beams 30, 32 are advanced through the cutout 156 of the shuttle conveyor 20 to close limit switch 190 and are in a ready position to pick up and transfer another mold positioned on the second portion 38 of the shuttle conveyor 20.

Figure 10:
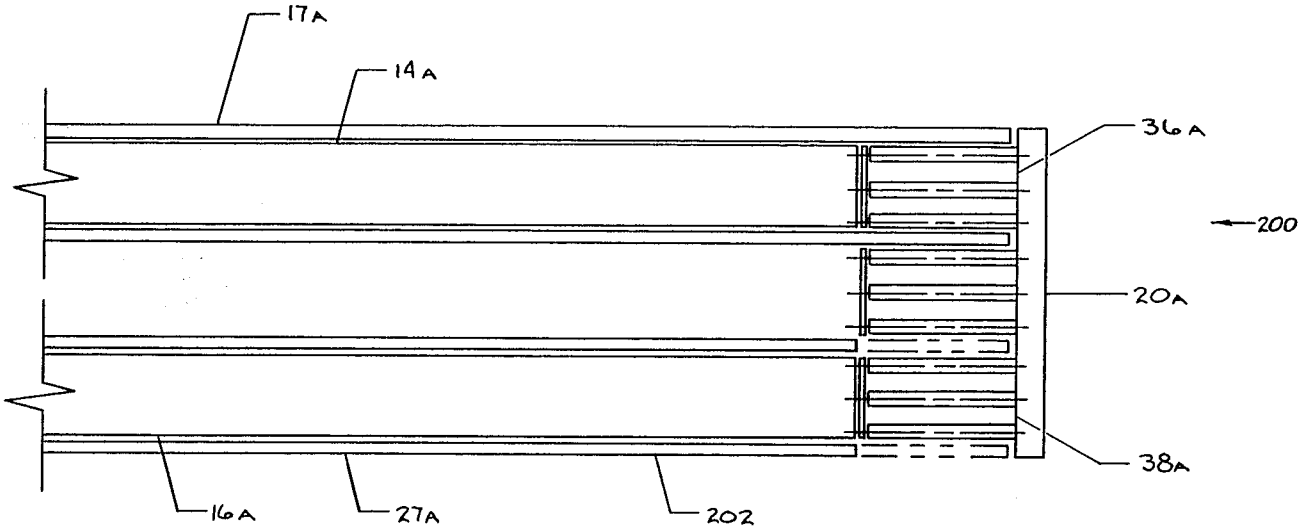
FIG. 10 is a schematic view of another conveyor transfer system made in accordance with the principles of this invention.

Another conveyor transfer system 200 of the present invention is shown in FIGS. 10, 11, 12, 13 and 14. For ease of description, the same numerals will be used in connection with similar components of the conveyor transfer system 10 described above followed by the suffix "a". The conveyor system 200 is provided for transferring a mold between first and second article-travel-paths **14*a*, 16*a* respectively as shown in FIG. 10**.

The conveyor transfer system 200 has a first conveyor **17*a* for moving the molds along the first article-travel-path 14*a* to the shuttle conveyor 20*a*. The shuttle conveyor 20*a* has a first portion 36*a* positioned adjacent to and in alignment with one of the ends of the conveyor 17*a* for receiving molds thereon transferred to the shuttle conveyor 20*a* the first conveyor 17*a*. The shuttle conveyor 20*a* transfers the molds from the first portion 36*a* to a second portion 38*a* positioned adjacent to and in alignment with the article-travel-path 16*a* of the second conveyor 27*a*. The molds are then transferred from the second portion 38*a* of the shuttle conveyor 20*a* to the second conveyor 27*a* and thence are moved on the conveyor 27*a* along the article-travel-path 16*a***.

The first and second conveyors **17*a*, 27*a* respectively, are similar in construction and design and for ease of description, only the first conveyor 17*a*** will be hereinafter described in detail.

Figure 11:
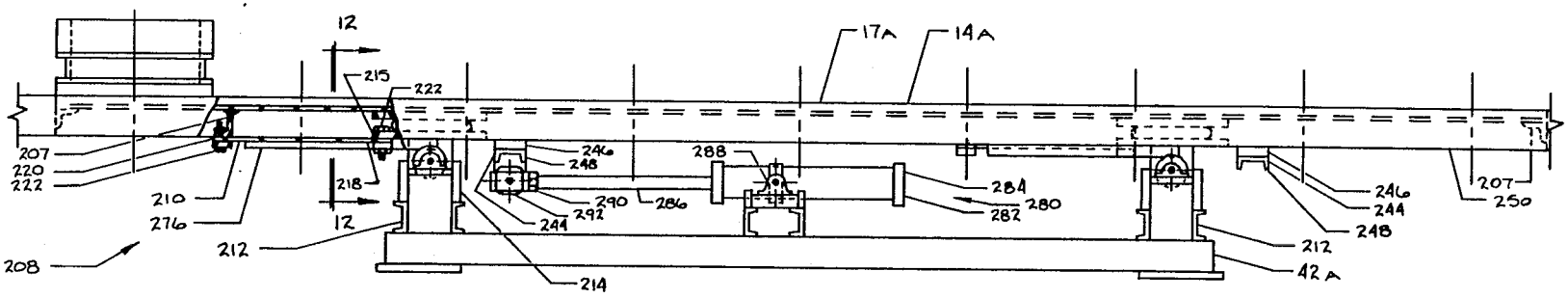
FIG. 11 is a side elevational view of a portion of the conveyor transfer system shown in FIG. 10 and showing an apparatus for moving articles along a conveyor.
Figure 12:
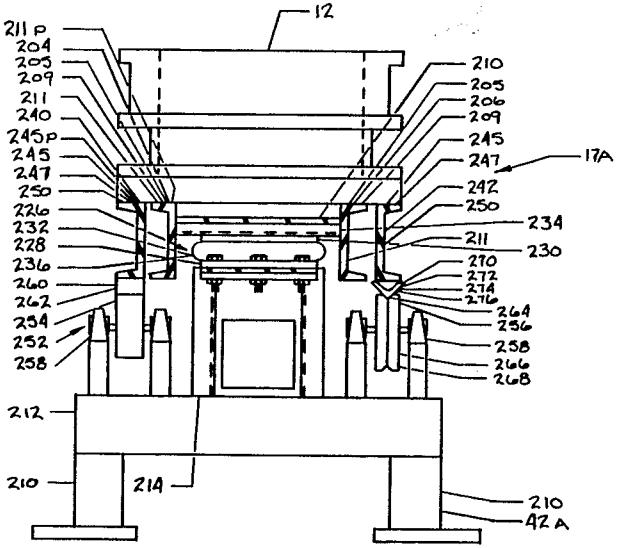
FIG. 12 is an expanded sectional view of a portion of the conveyor system shown in FIG. 11 and taken along lines 12—12 thereof.

The first conveyor **17*a* includes a frame 42*a*, as seen in FIGS. 11 and 12, which rests on the floor of the facility in which the system 200 is located. The frame 42*a* includes leg channels 210 resting on the floor and extending in the direction of the article-travel-path 14*a*. The frame 42*a* also has cross members 212 secured to and extending between the legs 210 and across the direction of the article-travel-path 14*a*. The frame 42*a* further includes an interior upright support 214 centrally located on and secured to the cross member 212** and extending vertically therefrom.

The conveyor **17*a* has a pair of vertically movable support members 204, 206**, respectively, to raise and lower the mold. The vertically movable support members 204, 206 are channel members extending along the article-travel-path 14*a* and having their upper and lower flanges 205, 209 respectively positioned in a direction away from the adjacent vertically movable support member. The vertically movable support members 204, 206 are adjacent to and spaced a predetermined distance from each other by means of the cross members 207 the cross members have opposite ends thereof secured to the respective support members 204, 206. The upper flanges 205 of the members 204, 206 have upper support surfaces 211 for selectively supporting the mold thereon as will be further described. When the cross members 207 are secured to the support members 204, 206, the upper support surfaces 211 define and lie in substantially the same plane or support plane 211*p*. Accordingly, when the vertically movable support members 204, 206 are moved in a vertical direction, they move as a unit and the support plane 211*p* is moved between a raised and a lowered position as will be herein described.

Means 208 is provided for attaching the vertically movable support members 204, 206 to the interior upright support 214 of the frame 42*a* while allowing for vertical movement of the support members and includes a flex plate 210. The upright support member 214 includes an upper plate portion 215 which extends along a portion of the article-travel-path 14*a* as seen in FIGS. 11 and 12.

The flex plate attaches the support members 204, 206 to the frame 42*a* while allowing vertical movement of the support members. The flex plate 210 is positioned between the members 204, 206 and has one end or side 218 secured to the upper plate portion 215 of the upright support 214 of the frame 42*a*. The other end 220 of the flex plate 210 is secured to the vertically movable support members 204, 206 by securing the end 220 of the flex plate 210 to one of the cross members 207 which is spaced from the support 214. Any known conventional means, such as the threaded fastener assemblies 222, are used to secure the ends 218, 220 of the flex plate 210 to the upper plate support 215 and cross member 207.

The flex plate 210 extends a substantial distance across the space between the support members 204, 206 and is of a thickness and material which allows for flexure of the plate 210 while maintaining the support members 204, 206 is alignment with the article-travel-path 14*a*. It should be understood that the conveyor 17*a* utilizes a plurality of flex plates 210. When the support members 204, 206 are moved in a vertical direction, the flex plates 210 control the movement of the support members 204, 206 so that they are maintained in alignment with the article-travel-path 14*a*.

It should be understood that it is within the contemplation of this invention to use other means to attach the support member 204, 206 to the frame 14*a* while allowing for vertical movement of the support members.

Means 226 is provided for moving the support members 204, 206 in a vertical direction between a raised and a lowered position. The vertical moving means 226 includes a base member or mounting plate 228 secured to the upper support plate 215 of the frame 42*a*. The vertical moving means 226 also includes an upper mounting plate 230 and an air bag or diaphram 232 positioned between the upper and lower mounting plates 230, 228.

A lift plate 234 is provided between the support members 204, 206 and above the upper mounting plate 230 and extends across the space between the support members 204, 206. The lift plate 234 is secured to the support members 204, 206 adjacent to the upper flanges 205 thereof by any conventional means, such as welding. The lift plate 234 is positioned above and in contact with the upper mounting plate 230 of the vertical moving means 226 so that when a force is exerted on the lift plate 234, the support members 204, 206 are movable in the direction of that force as controlled by the flex plate 210.

To provide such vertical movement of the members 204, 206, the air bag 232 is sealed with respect to the upper and lower mounting plates 230, 228 respectively, so that the air bag 232 and upper and lower mounting plates 230, 228 respectively, form an enclosed chamber 236 as will be more clearly described in connection with the vertical moving means disclosed in FIG. 18. The air bag 232 is made from a flexible material which allows for vertical movement between the upper and lower plates 230, 228 respectively. When a pressurized fluid is connected to the chamber 236, the chamber expands consequently moving the upper mnounting plate 230 away from the lower mounting plate 228, thus raising the support members 204, 206 to a raised position. When the pressurized fluid in the chamber 236 is vented, the pressurized fluid is vented from the chamber 236 and the upper mounting plate 230 and correspondingly the beams 204, 206 are lowered to a lowered position. Accordingly, the molds supported on the support surface 211 of the support members 204, 206 may be moved in a substantially vertical direction between a raised and a lowered position.

It should be understood that it is within the contemplation of this invention that other means may be provided to move the support members 204, 206 in a vertical direction.

The conveyor 17*a* includes horizontally movable beams 240, 242 which define the article-travel-path 14*a*. The beams 240, 242 extend along the article-travel-path 14*a* and may be of any construction, such as the channel-shaped beams shown. The beams 240, 242 are positioned outboard of the support members 204, 206 respectively, and are spaced a predetermined distance from each other.

The beams 240, 242 are secured together by means of the cross members 244 so that the upper support surface 245 of their upper flanges 247 are coplanar and positioned in a substantially horizontal support plane 245*p* which is substantially parallel with the support plane 211*p* of the support members 204, 206. The cross members 244 for so positioning the beams 240, 242 have upper portions 246 on opposite ends of the connecting portion 248 of the cross member 244. The upper portions 246 are secured to the lower flange 250 of each of the beams 240, 242 and extend downward thereof to the connecting portion 248. The connecting portion 248 extends across the space between the beams 240, 242 and are positioned a sufficient distance beneath the vertically movable support members 204, 206 to allow for vertical movement of the support members 204, 206 as will be herein described. It should be understood that the upper portion 246 of the cross members 244 are secured to the lower flanges 250 of the beams 240, 242 in any conventional manner known to those skilled in the art, such as welding.

The conveyor 17*a* includes means 252 for attaching the horizontally movable beams 240, 242 to the frame 42*a* while allowing for horizontal movement of the beams 240, 242. The attaching means 252 includes a roller 254 and a guide roller 256 each of which rollers are rotatably secured to the frame 42*a* by means of the bearings 258. The roller 254 is rotatably mounted on the frame 42*a* so that the axis of rotation of the roller 254 is perpendicular to the article-travel-path 14*a*. A wear plate 262 is attached to the lower flange 250 of the beam 240. The outer circumferential surface 260 of the roller 254 is cylindrical in shape and bears against the wear plate 262. The wear plate 262 is provided to avoid wear on the beams 240 and may be replaced to allow for long life and improved strength of the beam 240.

The guide roller 256 is rotatably mounted on the frame 42*a* by means of the bearings 258 with the rotational axis of the guide roller 256 perpendicular to the article-travel-path 14*a*. The guide roller 256 has a depression 264 about the circumference thereof. The depression 264 includes a radially and axially inwardly extending portion 266 from one side of the guide roller 256 and another radially and axially inwardly extending portion 268 from the other side of the guide roller 256. The surfaces 266, 268 form a circumferential depression 264 in the guide roller 256 in the cross sectional shape of a "v".

A guide plate 270 is provided and is secured to the lower flange 250 of the beam 242 in the area adjacent to the guide plate 270. The guide plate 270 has angular guide surfaces 272, 274 forming a protrusion 276 which is complimentary to the depression 254. The protrusion 276 is received by and cooperated with the circumferential depression 264 in the guide roller 256. It should be understood that the protrusion 276 and the depression 264 may be of any suitable complimentary configuration.

It should be further understood that the beams 240, 242 are supported by other rollers as described above so that the means 252 are provided for suitably attaching the frame 42*a* to the beams 240, 242 while allowing for horizontal movement thereof between an extended and retracted position along the article-travel-path 14*a* as will hereinafter be more fully described.

Means, generally indicated at 280, are provided for moving the horizontally movable beams 240, 242 in a horizontal direction between a retracted and an extended position and include an index cylinder 282 drivingly interconnecting the frame 42*a* and the beams 240, 242. The index cylinder 282 may be of any known design, such as an air-hydraulic cylinder 110 described above and includes a housing cylinder 284 and a piston rod 286 which operate to reciprocate with respect to each other in a known manner when fluid pressure is applied in one direction or the other. A pivotal mount 288 is provided to pivotally mount the cylinder housing 284 to the frame 42*a*. The outboard end 290 of the piston rod 286 is pivotally mounted by the pivotal mount 292 to the cross member 244 and consequently to the beams 240, 242. The pivotal mounts 288 and 292 allow for free horizontal movement of the beams 240, 242 without creating binding forces on the index cylinder 282.

The index cylinder 282 is movable between a retracted and extended position in any known manner. As shown in FIG. 11, the index cylinder 282 is in an extended position. When the index cylinder 282 is moved to a retracted position, the beams 240, 242 move along the article-travel-path 14*a* and are maintained in the article-travel-path 14*a* by the cooperation of the guide protrusion 276 on the guide plate 270 and the complimentary depression 264 in the guide roller 256.

In operation, the bottom of a mold 12 is supported on the horizontally movable beams 240, 242 on the support plane 245*p* of the beams. When the index cylinder 282 is moved from an extended position to a retracted position of the beams 240, 242 are correspondingly moved from a retracted position to an extended position to advance the mold 12 supported thereon along the article-travel-path 14*a*. As the horizontally movable beams 240, 242 are so moved, the mold 12 is moved from a retracted position to an extended position. When the support members 204, 206 are moved to the extended position, the support plane 211*p* of the support members is below the support plane 245*p* of the beams 240, 242.

When the beams 240, 242 and the molds supported thereon reach an extended position, pressurized fluid is applied to the chamber 236 to move the support members 204, 206 in a substantially vertical direction from a retracted position in which the support plane 211*p* of the support members is beneath the support plane 245*p* of the support members 240, 242 to an extended position. When the support members 204, 206 are so moved, the support surface 211 contacts and lifts the bottom of the mold 12 from contact with the horizontal movable support beams 240, 242 and vertically upward to a raised position.

The index cylinder 282 is then moved from a retracted position to an extended position correspondingly moving the movable beams 240, 242 from an extended position to a retracted position while the molds remain in a raised position supported above the horizontally movable beams 240, 242 by the support members 204, 206. After the horizontally movable beams 240, 242 reach a retracted position, fluid pressure is exhausted from the chamber 236 so that the support members 204, 206 lower to their retracted position in which the support plane 211*p* is below the support plane 245*p*. In this position, the bottom of the mold is supported on the support surfaces 245 of the horizontally movable beams 240, 242. When the vertically movable support members 204, 206 reach their retracted position horizontal movement of the mold 12 is allowed along the article-travel-path 14*a* by horizontal movement of the beams 240, 242 from a retracted position to an extended position.

Accordingly, the molds 12 are advanced along the article-travel-path 14*a* until they reach the shuttle conveyor 20*a*.

Figure 14:
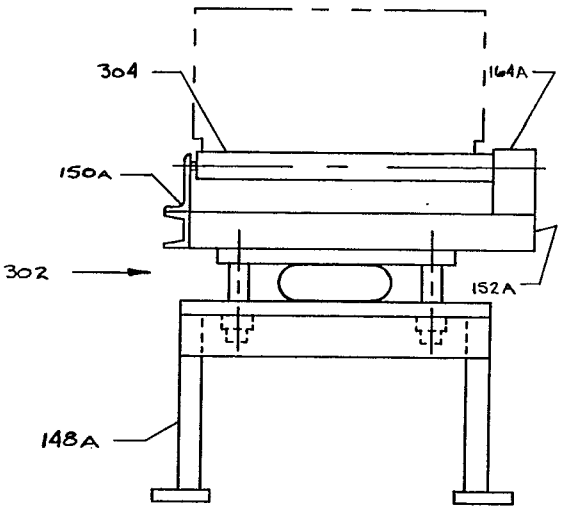
FIG. 14 is an expanded side elevational view of a portion of the conveyor transfer system shown in FIG. 13.
Figure 13:
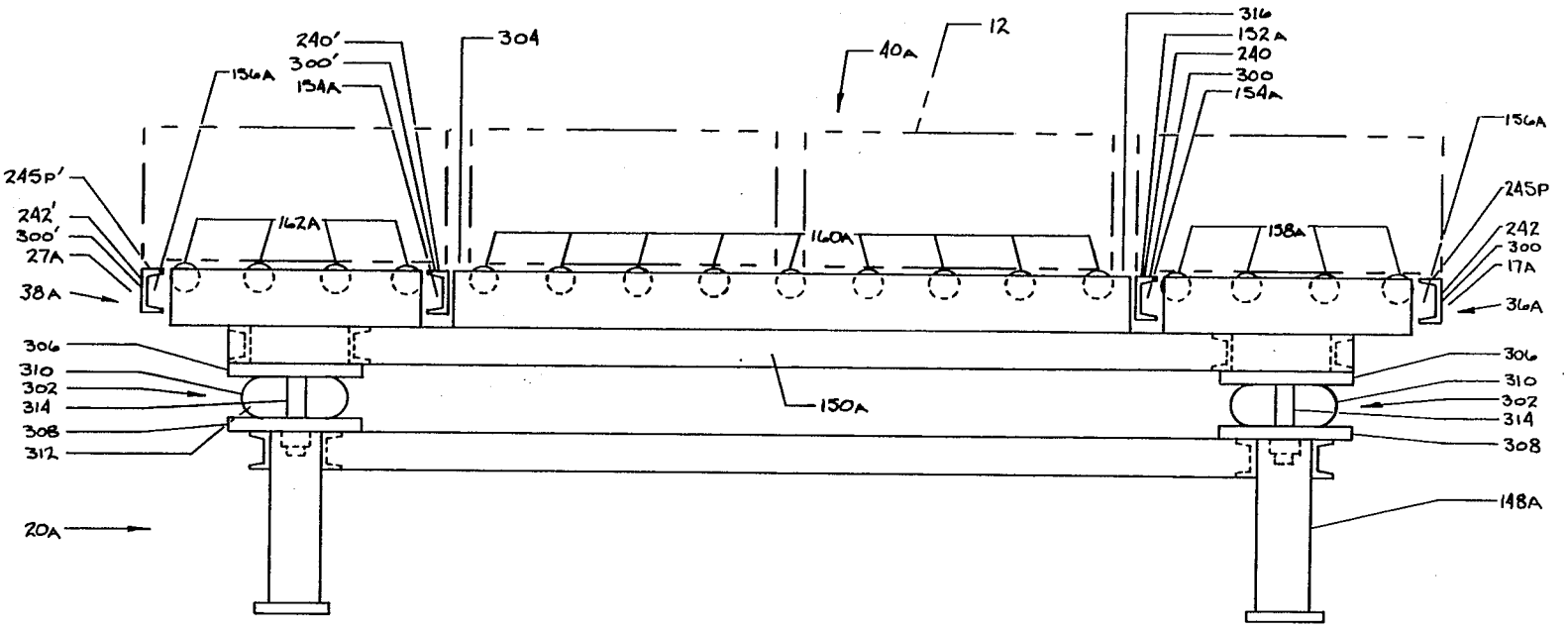
FIG. 13 is an expanded side elevational view of a portion of the conveyor transfer system shown in FIG. 10.

In order to transfer the mold 12 to the end of the conveyor 17*a* closest to the shuttle conveyor 20*a*, as seen in FIGS. 10, 13 and 14, the transfer end portions 300 of the horizontally movable beams 240, 242 have sufficient length so that when the beams are in the extended position, the transfer end portions 300 extend across the first portion 36*a* of the shuttle conveyor 20*a*. In the extended position, the transfer end portions 300 of the beams 240, 242 position the mold to be transferred to the shuttle conveyor above the first portion 36*a*. The distance the movable beams 240, 242 move between the extended and retracted position is sufficient distance so that the transfer end portions 300 are fully retracted from the first portion 36*a* of the shuttle conveyor 20*a* when in the retracted position.

The shuttle conveyor 20*a*, as seen in FIGS. 13 and 14, is similar in construction to the shuttle conveyor 20 described above. The shuttle conveyor 20*a* includes a base, generally indicated at 148*a*, for supporting the shuttle conveyor 20a. The first portion 36a of the shuttle conveyor 20a is positioned on one end of the frame 148a and the second portion 38a is positioned on the other end of the frame 148a with a transfer means 40a positioned therebetween. The portions 36a, 38a and 40a of the shuttle conveyor 20a are of the same construction as the portions 36, 38 and 40 respectively, described above in connection with with the shuttle conveyor 20.

The rollers 158a, 160a, and 162a of the portions 36a, 38a and 40a are rotatably supported on the opposing frame members 150a, 152a. The tops of the rollers 158a, 160a and 162a are coplaner and lie in the substantially horizontal support plane 304 of the shuttle conveyor 20a. When a mold is positioned on the shuttle conveyor 20a, the bottom of the mold 12 is supported by certain of the rollers 158a, 160a and 162a, dependent on the position of the mold, and supported in the support plane 304.

As described in connection with the transfer means 40, transfer means 40a includes a motor, schematically indicated at 164a, for rotating the rollers 158a, 160a and 162a as described in connection with the motor 164 and rollers 158, 160 and 162 above. When the motor 164a is activated, power is transmitted to drive the rollers 158a, 160a and 162a. When the rollers 158a, 160a and 162a rotate, they move the mold supported thereon between the end portions 36a, 38a of the shuttle conveyor 20a.

Means are provided for vertically moving the frame 150a, 152a of the shuttle conveyor 20a in a vertical direction between a raised and a lowered position.

The inner channel member 150a is located in a position adjacent to the first and second conveyors 17a, 27a respectively, and has cutouts 154a, 156a. The cutouts 154a, 156a receive the movable beams 240a, 242a on the first conveyor 17a and the complimentary movable beams of the second conveyor 27a respectively when the beams 240, 242 are in an extended position and when the respective beams of the conveyor 27a are in a retracted position as described above in connection with the first and second conveyors 17, 27 respectively.

When the shuttle conveyor 20a is in the lowered position, the support plane 304 of the shuttle conveyor 20a is below the support plane 245p of the beams 240, 242 to provide for transfer of the mold from the conveyor 17a to the shuttle conveyor 20a and subsequently from the shuttle conveyor 20a to the second conveyor 27a as will hereinafter be more fully described. In the raised position, the support plane 304 of the shuttle conveyor 20a is positioned above the support plane 245p to allow the transfer of a mold from the first portion 36a to the second portion 38a of the shuttle conveyor 20a. The means 302 for moving the rollers 158a, 160a and 162a in a vertical direction is positioned between the frame 150a, 152a and the lower frame 148a.

The vertical moving means 302 includes an upper and a lower mounting plate 306, 308 respectively, and an air bag or diaphram 310 positioned between the mouting plates. The upper mounting plate 306 is secured to the upper frame members 150a, 152a and the lower mounting plate is secured to the frame 148a of the shuttle conveyor 20a.

To uniformly move the upper frame 150a, 152a so that the support plane 304 is maintained in a horizontal position when moved between the raised and lowered position, an upper and lower mounting plate and air bag, 306, 308 and 310 respectively, are positioned at each end of the frame 148a underneath each of the portions 36a and 38a of the shuttle conveyor 20. For ease of description, only one such vertical moving means is herein described but it should be understood that each moving means 302 is constructed in a similar manner. It should be understood that the vertical moving means 302 provides for moving the components of the shuttle conveyor 20a so that the support plane 304 is maintained in a substantially horizontal position.

The upper and lower mounting plates 306, 308 and air bag 310 describe an expandable chamber 312 in a manner as will be herein more fully described in connection with the moving means 324 disclosed in connection with FIG. 18. The air bag or diaphragm 312 is of a flexible material which allows for vertical movement of the upper and lower mounting plates 306, 308 in a manner as described above in connection with the air bag 232 and upper and lower plates 230, 228 in FIGS. 11 and 12.

Accordingly, when pressurized fluid is supplied to the chamber 312, the upper plate 306 and correspondingly the support plane 304 is moved to a raised position. When pressurized fluid is vented from the chamber 312, the upper mounting plate 306 and correspondingly the support plane 304 of the shuttle conveyor 302 is moved to a lowered or retracted position. As described above, the support plane 304 is above the support plane 245p of the beams 240, 242 in a raised position. When the support plane 304 of the shuttle conveyor 20a is in the lowered position, the support plane 304 is beneath the support plane 245p of the beams 240, 242.

Means 314 are provided for limiting the vertical movement of the support plane 304 in the raised position and limiting downward movement of the support plane 304 so that the raised and lowered positions of the support plane 304 are predetermined. The limit means 314 will be hereinafter more clearly described in connection with the apparatus described in connection with FIG. 18 and allows for adjustment of the raised and lowered positions as will be hereinafter described.

In operation, the support plane 304 of the shuttle conveyor 20a is positioned in a lowered position. The bottom of a mold 12 is supported on the extension portions 300 of the horizontally movable beams 240, 242 of the conveyor 17a and positioned adjacent to the first portion 36a of the shuttle conveyor 20a. The beams 240, 242 are then moved from a retracted position to an extended position. As the beams 240, 242 are so moved, they are received in the openings 154a, 156a in the shuttle conveyor 20a and the mold supported thereon is moved to a position above the portion 36a of the shuttle conveyor 20a as seen in FIGS. 13 and 14.

The moving means 302 is then activated to move the support plane 304 from a lowered position to a raised position. As the support plane 304 is so moved, the rollers 158a contact the bottom of the mold and continue to move in a vertical direction to support and raise the mold above the beams 240, 242. After the support plane 304 of the conveyor 20a reaches the raised position, the rollers 158a, 160a and 162a are activated to move the mold along the article-travel-path 316 in a direction from the first portion 36a to the second portion 38a of the shuttle conveyor 20a. When the mold reaches the second portion 38a, the bottom of the mold is supported by the rollers 162a in the raised position.

As described above, the conveyor 27a is similar in construction to the conveyor 17a and accordingly, the same numerals will be used to designate common components of the shuttle conveyor 27a followed by a prime mark (').

Either simultaneously with or after movement of the mold from the first portion 36a to the second portion 38a of the shuttle conveyor 20a, the extended portion 300 of the beams 240, 242 of the first conveyor 17a are moved from an extended to a retracted position and the extension portions 300' of the beams 240', 242' of the second conveyor 27a are moved to a retracted position. In the retracted position, the extension portions 300' are received in the openings 154a, 156a of the shuttle conveyor 20a so that the support plane 245p' of the beams 240', 242' are beneath the support plane 304 of the shuttle conveyor 20a. The vertical moving means 302 is then activated to provide movement of the support plane 304 from a raised position to lowered position. As the support plane 304 is so moved, the bottom of the mold comes into contact with and is supported by the beams 240', 242' of the conveyor 27a. The support plane 304 of the shuttle conveyor 20a continues to move to the lowered position so that the top of the rollers 162a and correspondingly the support plane 304 is positioned beneath the support plane 245p' of the beams 240', 242'.

Once the bottom of the mold is supported on the beams 240', 242', the beams 240', 242' are moved to an extended position and accordingly the mold is moved along the article-travel-path 16a of the conveyor 27a in a manner as described in connection with the conveyor 17a. During movement of the beams 240', 242' of the conveyor 27a from the retracted to extended position, the beams 240, 242 of the conveyor 17a are moved from a retracted to an extended position to position another mold over the first portion 36a of the shuttle conveyor 20a.

Accordingly, the first and second conveyors 17a, 27a and shuttle conveyor 20a provide for the movement of a mold 12 along the conveyor 17a, and the transfer of the mold by shuttle conveyor 20a from the conveyor 17a to the conveyor 27a.

Yet another embodiment of the present invention is disclosed in FIGS. 15, 16, 17, and 18. The conveyor embodiment disclosed in FIGS. 15 through 18 provide for the use of a conveyor similar in construction to the conveyor 17a and 27a described above yet allows for selective accumulation and the selective transfer of molds thereon. Accordingly, for ease of description, similar numerals will be used in connection with describing the conveyor disclosed in FIGS. 15 through 18 are those used in connection with describing the conveyor 17a followed by the suffix of a double prime (").

The conveyor 17a" has a frame 42a", a plurality of vertically movable support members 320 spaced along the article-travel-path 14a" which allow for accumulation and the selective transfer of molds on the conveyor 17a". Means 322 are provided for individually attaching the support members 320 to the frame 42a" and means 324 are provided for moving each of the support members in a vertical direction between a raised and a lowered position independent of the vertical movement of the other support members 320. Means 326 are provided for limiting the movement of the support members 320 between the raised and lowered positions and allow for adjustment of the raised and lowered position of the support members 320.

The conveyor 17a" includes the horizontally movable beams 240" and 242". Means 252" are provided for attaching the horizontally movable beams 240", 242" to the frame 42a" while allowing for horizontal movement of the beams. The attaching means includes the roller 254" and guide roller 256" having a depression 264" therein. The depression 264" cooperates with the protrusion 276" as described above in connection with the beam 242 and guide roller 256.

Means, generally indicated at 280". are provided for moving the horizontally movable means 240", 242" in a horizontal direction between the retracted and the extended position and include an index cylinder 282". The piston rod 286" of the index cylinder 282" is pivotally connected by the pivotal mount 288", to the connecting portion 248" of the cross member 244". The upper portions 246" of the cross member 244" are connected to the horizontally movable beams 240", 242". The upper surfaces 245 ∝ of the beams 240", 242" are coplanar and are positioned in a substantially horizontal support plane 245p" which is substantially parallel with the support plane 211p" of the support members 320.

Figures 18, 19, 20, 21:
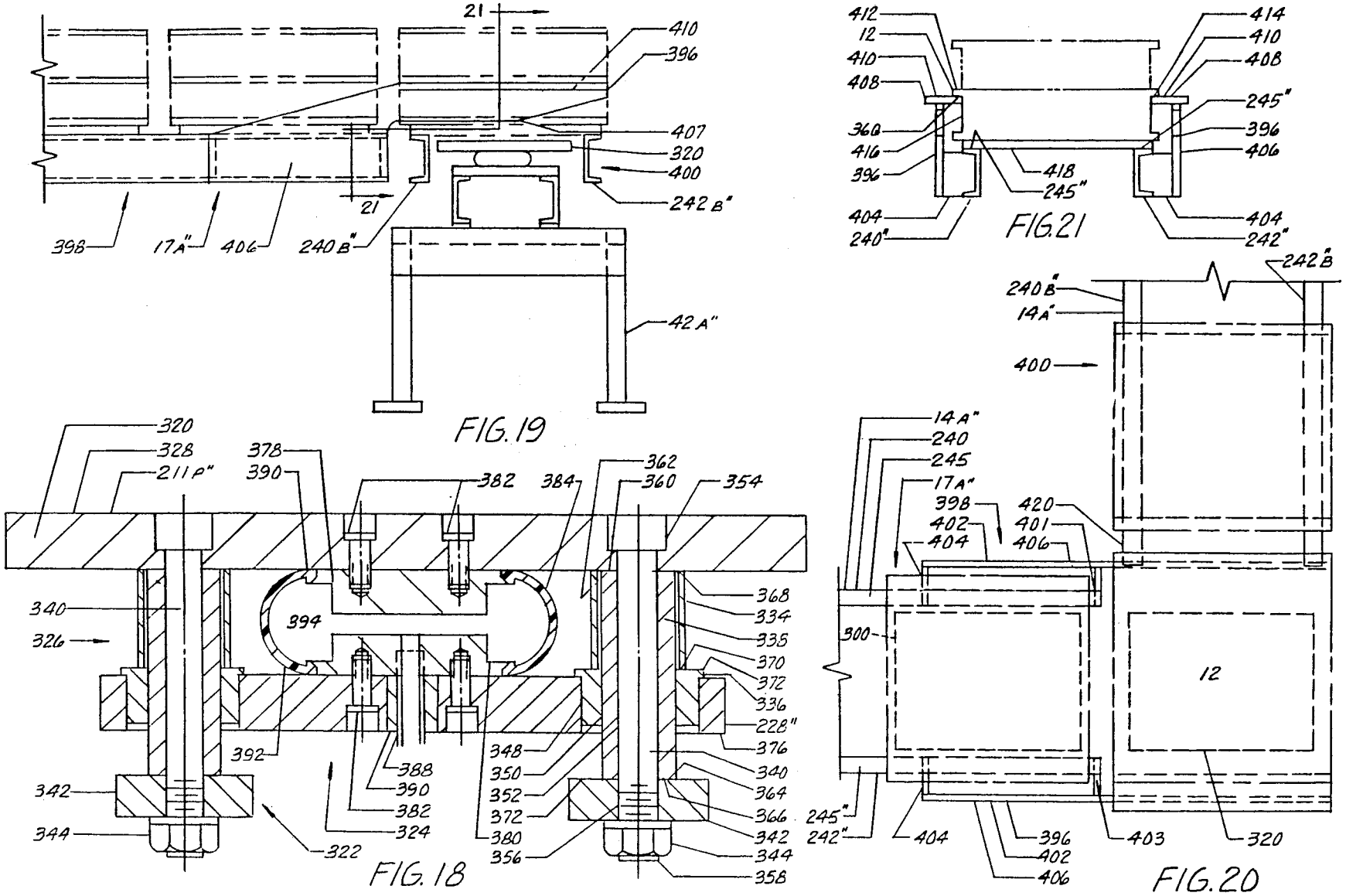
FIG. 18 is an expanded sectional view of the portion of the conveyor transfer system shown in FIG. 15 and taken along lines 18—18 thereof.
FIG. 19 is a schematic plan view of another embodiment of the conveyor transfer system of the present invention.
FIG. 20 is a side elevational view of the conveyor transfer system shown in FIG. 19.
FIG. 21 is an expanded sectional view of the conveyor transfer system shown in FIG. 19 and taken along lines 21—21 thereof.

One of the support members 320 disclosed in the embodiment described in FIGS. 15 through 18 is shown in an expanded view in FIG. 18. The support member 320 is designed to include the air bag 234 and upper mounting plate 230 and vertically movable support members 204, 206 as described above in connection with the embodiment disclosed in FIGS. 10 through 14 as one member, 320. It should be further understood that each of the support members 320 in the embodiment described in FIGS. 15 through 18, are similar in construction and for ease of description only one such support member and means for attaching 322 and means for moving 324 the support member 320 will be hereinafter described.

FIG. 18 shows one support member 320 having an upper surface 328 which describes the support plane 211p" of the support member 320. The support plane 211p" is movable from a retracted position 330 shown in FIGS. 16 and 17 to a raised position 332 in which the mold is moved to the raised position indicated by the dashed lines at 332.

As seen in FIG. 18, the means 324 for moving and means 322 for attaching the support member 320 are provided. The means for attaching 322 and means for moving 324 the support plate 320 include a lower support plate portion or base member mounting plate 228" which is secured to the upright support portion 214" of the frame 42a".

The means 322 for attaching the support member 320 of the frame 42a and the means 326 for limiting movement of the support plate 320 between the raised and lowered positions also includes an outer collar 334, bearing member 336, inner collar 338, guide bolt 340, washer 342, and threaded fastener 344. The lower mounting plate 228" includes an opening 348 for receiving the bearing member 336 therein. The bearing member 336 is attached to the lower plate 228" and restrained from downward axial movement though the opening 348 in the plate 228". The bearing member 336 has an opening 350 for receiving the inner collar 338 therein to allow for sliding movement between the bearing member 336 and inner collar 338.

The guide bolt 340 is received in the opening 354 in the support member 320 and extends therethrough. The bolt 340 passes through the centrally located opening 352 in the inner collar 338 and an opening 356 in the washer 342. The threaded fastener 344 threadedly engages the end 358 of the guide bolt 340 and is tightened to urge the lower surface 360 of the support member 320 into engagement with the upper surface 362 of the inner collar 338 and also urge the lower surface 364 of the collar 338 into engagement with the upper surface 366 of the washer 342. Such a connection between the support member 320 and the lower plate 228" secured to the frame 42a provides for a sliding engagement therebetwen and allows the support member 320 to be moved between the raised and lowered positions.

The means 326 for limiting the vertical movement of the support member 320 provides for determining and limiting the position of the support member 320 in both the raised and lowered positions. The lowered position of the support member 320 is determined by the length of the outer collar 334. In the lowered position, the upper surface 368 of the collar 334 contacts the lower surface 360 of the support 320 and the lower surface 370 of the outer collar 334 contacts the upper surface 372 of the bearing member 336. Accordingly, the outer collar 334 prohibits further lowering of the support member 320 and the length of the outer collar 334 determines the lowered position of the support member 320.

The length of the inner collar 338 determines the raised position of the support member 320. When the support member 320 is moved to the raised position, the upper surface 372 of the washer 342 contacts the lower surface 376 of the bottom support plate 228" which is secured to the frame 42a". Accordingly, further upward movement of the support member 320 is prohibited.

Vertical moving means 324 are provide for moving the support member 320 between the raised and lowered position. The vertical moving means 324 includes upper and lower air bag mounting plates 378, 380 respectively secured to the support member 320 and lower support plate 228" respectively, by any conventional means, such as the threaded fasteners 382. An air bag or flexible diaphragm member 384 is provided. It should be understood that air bags are particularly advantageous since they require less maintanence than cylinder piston assemblys. The upper circumference 390 of the diaphragm 384 is sealed to the upper air bag mounting plate 378 and the lower circumferential surface 392 of the diaphragm 384 is sealed to the lower mounting plate 380. Accordingly, a chamber 394 is provided as described by the upper and lower mounting plates 378, 380 respectively, and the air bag or diaphragm 384.

When a pressurized fluid is directed into the chamber 394, the support member 320 and the lower support member 228" are moved apart from each other until the support member 320 reaches the raised position. In the reaised position the upper surface 372 of the washer 342 and the lower surface 376 of the member 228" contact each other and further vertical movement of the support member 320 is restrained. When fluid pressure is released from the chamber 394, gravity urges the support member 320 to move to the lowered position determined by the length of the outer collar 334 as described above. A conduit 388 is provided and extends through the member 228" and lower mounting plate 380 so that a source of pressurized fluid may be selectively connected or disconnected from the chamber 394.

By providing individual support member 320, the conveyor 17a" may be used as an accumulating conveyor. When the support member 320 is raised, the beams 240", 242" do not contact the mold and correspondingly do not move the mold along the article-travel-path 14a". In operation, the support plates 320 may all be moved to the raised position or lowered position as described in connection with the support members 204, 206. Alternately, any of the support members 320 may all be moved to the raised position and maintained in that position so that when the support beams 240", 242" are moved in a horizontal direction, the support beams will not carry the mold in that direction.

Such a design allows for accumulation of molds on the conveyor 17a" and the ability to individually control the transfer of molds therealong in any number of a series of alternative manners. For example, the conveyor 17a" may be used to compensate for breakdowns on a molding line.

Another embodiment of the present invention is disclosed in FIGS. 19, 20, and 21, which describes a transfer device 396 which is suitable for use with the conveyor system 10 shown in FIG. 1 having conveyors 17, 27 and 20 or the conveyor system 200 shown in FIG. 10 having the conveyors 17a, 27a and shuttle conveyor 20a or alternately the conveyor 17a" shown in FIGS. 15 through 18. For ease of description, the transfer device 396 will be described in connection with two conveyors 17a" which will be hereinafter designated as the conveyors 398, 400.

As shown in FIGS. 19, 20, and 21, the transfer device 396 is secured to the horizontally movable support beams 240", 242" of the conveyor 398. The transfer device 396 includes transfer members 402 secured to the beams 240", 242" on the end of the beams adjacent the conveyor 400. The transfer member 402 includes an outboard extension portion 404 secured to the ends 401, 403 of the beams 240", 242". The outboard extension portion 404 extends outboard of the mold resting on the support surface 245" of the beams 240", 242" and is positioned beneath the surface 245". The transfer member 402 also includes a side portion 406 terminating in an inboard extension portion 408. The beam extension portion 407 of the side portion 406 extends past the ends 401, 403 of the beams 240", 242" a sufficient distance so that when the beams are in an extended position, the beam extension 407 extends across the conveyor 400. The transfer member 402 has extending inwardly thereof an inboard extension portion 408 defining the upper support surface 410.

The article to be transferred, such as a mold 12, has an upper lip 412 having a bottom surface 414 protruding outwardly of the side 416 of the mold 12. The mold 12 also has a bottom surface 418 which is supportable on the surfaces 245" of the beams 240", 242". The vertical distance between the bottom 418 of the mold 12 and the bottom surface 414 of the upper lip 412 of the mold is equal to the vertical distance between the support surfaces 245" of the beams 240", 242" and the upper support surface 410 of the transfer member 402. Accordingly, the mold 12 may be supported either by the upper lip 412 and the transfer members 402 or moved along the conveyor 17a" by means of the beams 240", 242".

It should be understood that it is fully within the contemplation of the present invention to utilize the transfer device 396 with conveyors of a wide variety of constructions and designs for purposes of transferring articles from one conveyor to another. It should be further understood that the transfer device 396 may be used to pick articles off such a conveyor at any convenient point of an article-travel-path without interference with the conveyor.

Figure 15:
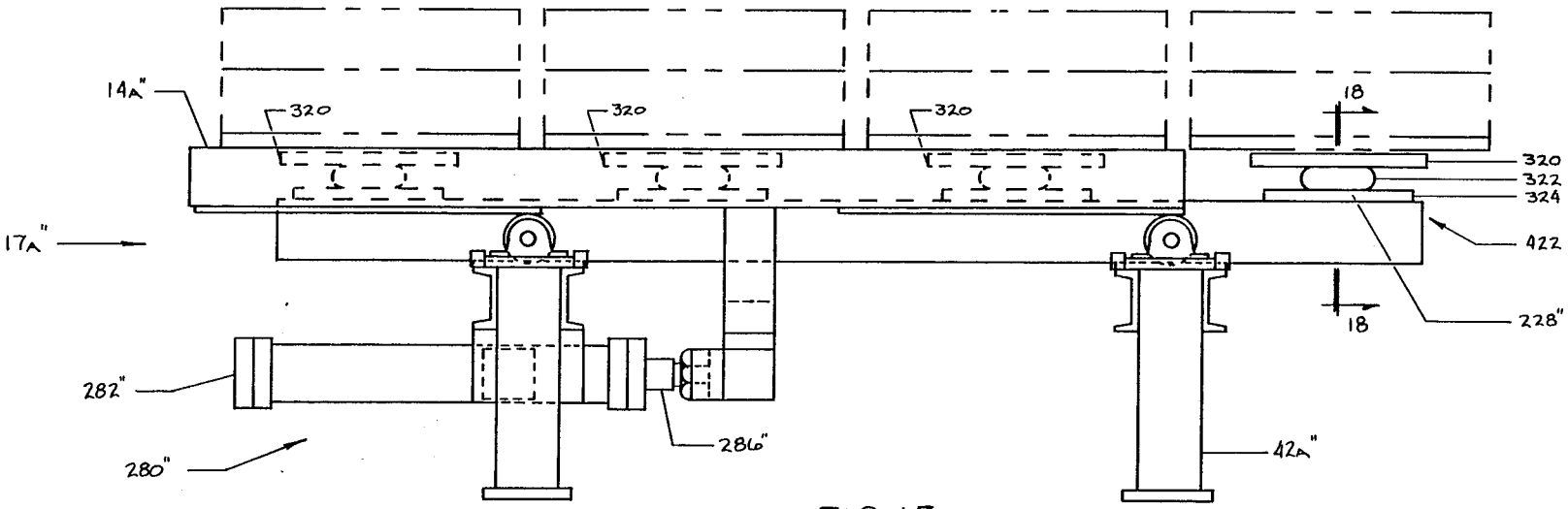
FIG. 15 is a side elevational view of a portion of yet another conveyor transfer system made in accordance with the principles of this invention.
Figure 16:
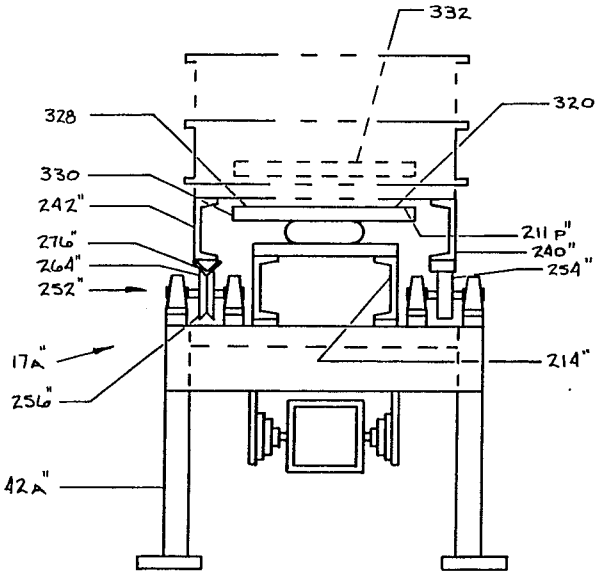
FIG. 16 is a side elevational view of one end of the conveyor transfer system shown in FIG. 15.
Figure 17:
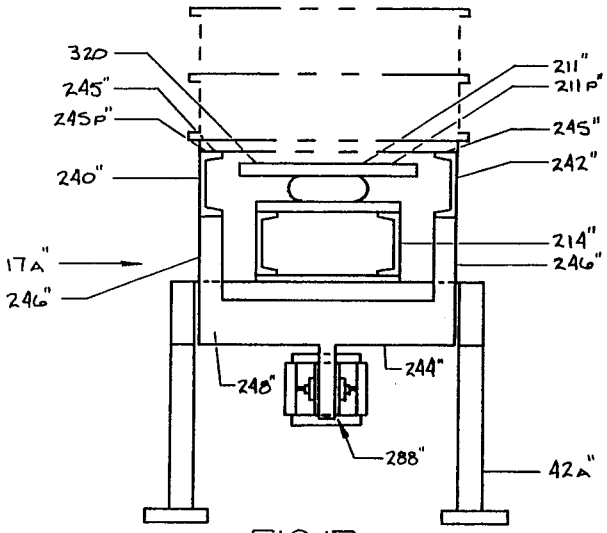
FIG. 17 is a side elevational view of the other end of the portion of the conveyor transfer system shown in FIG. 15.

The transfer device 396 of the present invention provides for transferring a mold 12 between the first and second article-travel-paths, 14a", 14a"' respectively of the conveyors 398, 400 respectively. The first conveyor 398 has support members 320 for supporting an article thereon and movable beams 240'', 242'' defining the first article-travel-path 14a'' and adjacent to the support member 320. The beams 240'', 242'' have a support surface 245'' for supporting the bottom 418 of the mold 12 thereon. Means 280'', as seen in FIG. 15, are provided for moving the beams 240'', 242'' in a horizontal direction between an extended and a retracted position. The second conveyor 400, shown in FIGS. 19–21, has a first portion 420 including a support member 320 and means for attaching the support member to the frame 42a'' and means for vertically moving the support member 320 in a vertical direction as described above in connection with FIGS. 17 and 18. The first portion 420 is in alignment with the first article-travel-path 14a'' to form a continuation thereof. The beams 240'', 242'' of the conveyor 402 have a transfer member 402 with a beam extension portion 407 extendable above and across the first portion 420 of the second conveyor 400 when the beams 240'', 242'' are in an extended position. The transfer member 402 has an upper support surface 410 positioned above the support surface 245'' of the beams 240'', 242'' a distance substantially equal to the distance between the bottom 418 of the mold 12 and the bottom surface 414 of the upper lip 412.

The support surfaces 245'' of the beams 240'', 242'' support the bottom of the mold 12 and transfer the mold to the endmost support member 320 of the conveyor 398. The vertically movable support member 320 is then moved from a lowered position where it is positioned beneath the bottom 418 of the mold 12 to a raised position in which the mold is supported by the support member above the beams. The beams 240'', 242'' are then moved from an extended to a retracted position and the upper surface 410 of the inboard extension portion 408 of the transfer member 402 is positioned beneath the bottom surface 414 of the upper lip 412 of the mold 12.

The support member 320 is then moved from the raised position to the lowered position so that the mold 12 is supported on the beam extension portion 407 of the transfer member 402 and past the ends 401, 403 of the beams 240'', 242'' respectively. The beams 240'', 242'' are then moved from a retracted position to the extended position and accordingly the mold is positioned above the first portion 420 of the second conveyor 400. The second conveyor 400 includes a support member 320 and associated apparatus for raising and lowering same. The support member 320 describing the first portion 420 of the second conveyor 400 is then moved to a raised position to support the bottom of the mold 12 thereon and the beams 240'', 242'' and consequently the transfer device 396 is subsequently moved to a retracted position. The beams 240b'', 242b'' are then moved to a retracted position with their ends positioned underneath the mold transferred to the first portion 420 of the second conveyor 400. Consequently, the support member 320 describing the first portion 420 of the second conveyor 400 is moved to a lowered position so the mold is supported on the beams 240b'', 242b''. The mold is then transferred from the first portion 420 along the conveyor 400. It should be understood that the conveyor 400 may be of any known design and has for convenience been described above as the design of conveyor 17a.

Accordingly, it can be seen from the above any versatile conveyor transfer apparatus is provided by the present invention which can be utilized with conveyors of a variety of constructions and designs.

Having described my invention I claim:

1. An article conveyor system for use in a foundry to transfer between a first and second article-travel-path an article having a bottom and outwardly protruding upper portion spaced a predetermined distance above the bottom of the article, said system comprising a first conveyor means having at least one vertically movable support member for supporting an article thereon, at least one movable beam defining said first article-travel-path and positioned adjacent said at least one support member, said at least one movable beam having a support surface for contacting the bottom of the article and supporting the bottom of the article thereon, means for moving said at least one movable beam in a horizontal direction between an extended and a retracted position, a second conveyor means having a first portion positioned across and in alignment with said first article-travel-path, to form a continuation of said first article-travel-path, said at least one movable beam of said first conveyor means having a transfer portion positionable across said first portion of said second conveyor means when said at least one movable beam is in an extended position, said transfer portion of said at least one movable beam having an upper support surface positioned above said support surface of said at least one movable beam, means for positioning the outwardly protruding upper portion of the article on said upper support surface of said transfer portion of said at least one movable beam when in the retracted position to support the article thereon, means for moving said at least one movable beam to position said transfer portion above said first portion of said second conveyor, means for supporting the bottom of the article on said first portion of said second conveyor means and means for retracting said transfer portion from a position above said first portion of said second conveyor.

2. An article conveyor system for use in a foundry to transfer between a first and second article-travel-path an article having a bottom and outwardly protruding upper portion spaced a predetermined distance above the bottom of the article as described in claim 1 wherein said upper support surface of said transfer portion is positioned a distance above said support surface of said at least one movable beam equal to the predetermined distance between the outwardly protruding upper portion and the bottom of the article.

3. A conveyor transfer system for use in a foundry to transfer an article between first and second article-travel-paths as described in claim 1 wherein said first conveyor means includes at least one guide roller rotatably secured to said frame along an axis perpendicular to said first article-travel-path, said one guide roller having a depression about the circumference thereof, said at least one horizontally movable beam of said first conveyor means having a guide protrusion extending along a portion of said at least one horizontal movable beam, said protrusion received by and cooperating with said circumferential depression in said guide roller.

4. A conveyor transfer system for use in a foundry to transfer an article between first and second article-travel-paths as described in claim 1 wherein said at least one vertically movable support member includes a plurality of support members for receiving an article thereon and including means for moving each of said plurality of support members in a substantially vertical direction between a raised and the lowered position independent of the vertical movement of the other of said support members.

5. A conveyor transfer system for use in a foundry to transfer an article between first and second article-travel-paths as described in claim 4 wherein said means for moving said support members of said first conveyor including an air bag positioned between each of said support members and said frame, wherein each of said air bags describes an expandable chamber.

6. A conveyor transfer system for use in a foundry to transfer between first and second article-travel-paths an article having a bottom and outwardly protruding upper portion spaced a predetermined distance above the bottom of the article, said system comprising first conveyor means having a frame, at least one vertically movable support member, means for attaching said at least one vertically movable support member to said frame while allowing vertical movement of said one support member, said means for attaching said at least one vertically movable support member to said frame of said first conveyor means including at least one flex plate having one side secured to said frame of said first conveyor means and an end secured to said at least one vertically movable support member of said first conveyor means, at least one horizontally movable beam defining said first article-travel-path and positioned outboard of and adjacent to said at least one vertically movable support member, means for attaching said at least one horizontally movable beam to said frame while allowing horizontal movement of said movable beam, said beam attaching means of said first conveyor means including at least one guide roller rotatably secured to said frame along an axis perpendicular to said first article-travel-path, said one guide roller having a depression about the circumference thereof, said at least one horizontally movable beam of said first conveyor means having a guide protrusion extending along a portion of said at least one horizontal movable beam, said protrusion received by and cooperating with said circumferential depression in said one guide roller, means for moving said at least one vertically movable support member of said first conveyor means in a vertical direction to move an article supported on said at least one support member between a raised and a lowered position, said means for moving said at least one vertically movable support member of said first conveyor means including an air bag positioned between said at least one vertically movable support member and said frame, wherein said air bag describes an expandable chamber, means for limiting the vertical movement of said at least one vertically movable support member of said first conveyor means between the raised and the lowered positions of said at least one vertically movable support member, means for moving said at least one horizontally movable beam in a horizontal direction to move an article supported thereon along said first article-travel-path; second conveyor means having a frame, at least one vertically movable support member, means for attaching said at least one vertically movable support member of said second conveyor means to said frame of said second conveyor means while allowing vertical movement of said at least one support member, at least one horizontally movable beam defining said second article-travel-path and positioned outboard of and adjacent to said at least one vertically movable support member of said second conveyor means, means for attaching said one horizontally movable beam to said frame of said second conveyor means while allowing horizontal movement of said horizontally movable beam, means for moving said at least one vertically movable support member of said second conveyor means in a vertical direction to move an article supported on said at least one vertically movable support member of said second conveyor means between a raised and a lowered position and means for moving said at least one horizontally movable beam of said second conveyor means in a horizontal direction to move an article supported thereon along said second article-travel-path; and shuttle conveyor means for transporting an article between said first conveyor means and said second conveyor means, said shuttle conveyor means having a plurality of chain driven rollers extending between and across said first and second article-travel-paths, said driven rollers of said shuttle conveyor means having a first portion positioned across and in alignment with said first article-travel-path to form a continuation of said first article-travel-path and a second portion positioned across and in alignment with said second article-travel-path to form a continuation of said second article-travel-path, said at least one horizontally movable beam of said first conveyor means having a transfer portion positionable across said first portion of said shuttle conveyor means said transfer portion of said at least one movable beam having an upper support surface positioned above said support surface of said at least one movable beam, means for positioning said outwardly protruding upper portion of the article on said upper support surface of said transfer portion of said at least one movable beam, said at least one horizontally movable beam of said second conveyor means having an end portion positionable across said second portion of said shuttle conveyor means, said transfer portion of said one movable beam having an upper support surface positioned above said support surface of said at least one movable beam, means for positioning said outwardly protruding upper portion of the article on said said upper support surface of said transfer portion of said at least one movable beam, means for moving said first portion of said shuttle conveyor means in a vertical direction between a raised and a lowered position and means for moving said second portion of said shuttle conveyor in a vertical direction between a raised and a lowered position and said shuttle conveyor means having transfer means for transferring an article from said first portion to said second portion of said shuttle conveyor means.

7. A conveyor transfer system for use in a foundry to transfer an article along an article-travel-path including a frame, a plurality of vertically movable support members, means for attaching said support members to said frame while allowing vertical movement thereof including at least one flex plate having one end secured to said frame and another end secured to at least one of said vertically movable support members, at least one horizontally movable beam defining said article-travel-path and positioned outboard of and adjacent to said support members, means for attaching said at least one beam to said frame while allowing horizontal movement thereof, means for moving said support members in a vertical direction between a raised and a lowered position to move an article supported thereon between the raised and the lowered positions, and means for moving said at least one beam in a horizontal direction to move an article supported thereon along said article-travel-path.

8. A conveyor transfer system for use in a foundry to transfer an article along an article-travel-path as described in claim 7 in which said means for moving said support members in a vertical direction includes means for moving each of said plurality of support members between the raised position and the lowered position independent of the vertical movement of the other of said support members.

9. A conveyor transfer system for use in a foundry to transfer an article having a bottom and an outwardly protruding upper portion between first and second article-travel-paths, said system comprising first conveyor means having a frame, at least one vertically movable support member, means for attaching said one vertically movable support member to said frame while allowing vertical movement of said at least one support member and at least one horizontally movable beam defining said first article-travel-path and positioned outboard of and adjacent to said at least one vertically movable support member, means for attaching said at least one horizontally movable beam to said frame while allowing horizontal movement of said movable beam, means for moving said at least one vertically movable support member of said first conveyor means in a vertical direction to move an article supported on said at least one support member between a raised and a lowered position, means for moving said at least one horizontally movable beam in a horizontal direction to move an article supported thereon along said first article-travel-path; second conveyor means having a frame, at least one vertically movable support member, means for attaching said one vertically movable support member of said second conveyor means to said frame of said second conveyor means while allowing vertical movement of said at least one support member, at least one horizontally movable beam defining said second article-travel-path and positioned outboard of and adjacent to said one vertically movable support member of said second conveyor means, means for attaching said one horizontally movable beam to said frame of said second conveyor means while allowing horizontal movement of said horizontally movable beam, means for moving said one vertically movable support member of said second conveyor means in a vertical direction to move an article supported on said one vertically movable support member of said second conveyor means between a raised and a lowered position and means for moving said one horizontally movable beam of said second conveyor means in a horizontal direction to move an article support thereon along said second article-travel-path; and shuttle conveyor means for transporting an article between said first conveyor means and said second conveyor means, said shuttle conveyor means having a plurality of chain driven rollers extending between and across said first and second article-travel-paths, said driven rollers of said shuttle conveyor means having a first portion positioned across and in alignment with said first article-travel-path to form a continuation of said first article-travel-path and a second portion positioned across and in alignment with said second article-travel-path to form a continuation of said second article-travel-path, said one horizontally movable beam of said first conveyor means having an end portion positionable in an extended position across said first portion of said shuttle conveyor means, said one horizontally movable beam of said second conveyor means having an end portion positionable in an extended position across said second portion of said shuttle conveyor means, means for moving said first portion of said shuttle conveyor means in a vertical direction between a raised and a lowered position and means for moving said second portion of said shuttle conveyor in a vertical direction between a raised and a lowered position and said shuttle conveyor means having a transfer means for transferring an article from said first portion to said second portion of said shuttle conveyor means, said one movable beam of one of said first and second conveyor means has a support surface for contacting and supporting the bottom of the article, said end portion of said one horizontally movable beam of said one of said first and second conveyor means includes a transfer portion positionable across said shuttle conveyor means when said one horizontally movable beam of said one of said first and second conveyor means is in an extended position, said transfer portion of said one movable beam of said one of said first and second conveyor means having an upper support surface positioned above said support surface of said one movable beam of said one of said first and second conveyor means, means for positioning said outwardly protruding upper portion of the article on said upper support surface of said transfer portion of said one movable beam of said one of said first and second conveyor means.

* * * * *